US008980507B2

(12) United States Patent
Shimizu et al.

(10) Patent No.: US 8,980,507 B2
(45) Date of Patent: Mar. 17, 2015

(54) POSITIVELY CHARGEABLE MONOLAYER ELECTROPHOTOGRAPHIC PHOTOSENSITIVE MEMBER AND IMAGE FORMING APPARATUS

(71) Applicant: KYOCERA Document Solutions Inc., Osaka (JP)

(72) Inventors: Tomofumi Shimizu, Osaka (JP); Eiichi Miyamoto, Osaka (JP); Hiroki Tsurumi, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 14/091,086

(22) Filed: Nov. 26, 2013

(65) Prior Publication Data

US 2014/0154619 A1 Jun. 5, 2014

(30) Foreign Application Priority Data

Nov. 30, 2012 (JP) ..... 2012-263699

(51) Int. Cl.

| | |
|---|---|
| ***G03G 5/00*** | (2006.01) |
| ***G03G 5/047*** | (2006.01) |
| ***G03G 5/06*** | (2006.01) |

(52) U.S. Cl.

CPC ..... *G03G 5/047* (2013.01); *G03G 5/0609* (2013.01); *G03G 5/0614* (2013.01); *G03G 5/0672* (2013.01); *G03G 5/0674* (2013.01); *G03G 5/0679* (2013.01)

USPC ..... 430/56

(58) Field of Classification Search

USPC ..... 430/56

See application file for complete search history.

(56) References Cited

U.S. PATENT DOCUMENTS

2008/0305418 A1* 12/2008 Hamasaki et al. ..... 430/78
2011/0299887 A1* 12/2011 Miyaji et al. ..... 399/159

FOREIGN PATENT DOCUMENTS

| | | | |
|---|---|---|---|
| JP | 2005-289877 | A | 10/2005 |
| JP | 2008-134406 | A | 6/2008 |
| JP | 2010-237511 | A | 10/2010 |
| JP | 2011-053326 | A | 3/2011 |
| JP | 2012-008523 | A | 1/2012 |
| JP | 2012-208231 | A | 10/2012 |

OTHER PUBLICATIONS

The extended European search report issued on Mar. 17, 2014, which corresponds to European Patent Application No. 13194583.4-1303 and is related to U.S Appl. No. 14/091,086.

* cited by examiner

*Primary Examiner* — Hoa V Le

(74) *Attorney, Agent, or Firm* — Studebaker & Brackett PC

(57) ABSTRACT

A positively chargeable monolayer electrophotographic photosensitive member includes a photosensitive layer provided on a conductive substrate and having a monolayer structure containing at least a charge generating material, a hole transport material, an electron transport material, and a binder resin. The photosensitive layer contains a hole transport material containing a triarylamine derivative represented by a formula (1) below and an electron transport material containing a compound selected from the group consisting of quinone compounds having a predetermined structure.

(1)

12 Claims, 7 Drawing Sheets

POSITIVELY CHARGEABLE MONOLAYER ELECTROPHOTOGRAPHIC PHOTOSENSITIVE MEMBER AND IMAGE FORMING APPARATUS

INCORPORATION BY REFERENCE

The present application claims priority under 35 U.S.C. §119 to Japanese Patent Application No. 2012-263699, filed Nov. 30, 2012. The contents of this application are incorporated herein by reference in their entirety.

BACKGROUND

The present disclosure relates to positively chargeable monolayer electrophotographic photosensitive members which include a photosensitive layer containing a hole transport material and an electron transport material each of which has a particular structure. The present disclosure also relates to image forming apparatuses including the positively chargeable monolayer electrophotographic photosensitive member as an image bearing member.

A type of electrophotographic image forming apparatus includes an electrophotographic photosensitive member. The electrophotographic photosensitive member is either an inorganic photosensitive member or an organic photosensitive member. The inorganic photosensitive member includes a photosensitive layer formed of an inorganic material such as selenium or amorphous silicon. The organic photosensitive member includes a photosensitive layer mainly formed of organic materials such as a binder resin, a charge generating material, and a charge transport material. The organic photosensitive member is more easily produced than the inorganic photosensitive member. The organic photosensitive member provides high design flexibility because there is a wide choice of materials for the photosensitive layer. Therefore, of these photosensitive members, the organic photosensitive member is more widely employed.

An example of the organic photosensitive member is a monolayer organic photosensitive member including a photosensitive layer which contains a charge generating material and a charge transport material in the same layer. It is known that the monolayer organic photosensitive member has a simpler structure and is more easily produced than a multilayer organic photosensitive member. It is also known that the occurrence of defective film can be reduced or prevented. The multilayer organic photosensitive member has a structure including a charge generating layer which contains a charge generating material and a charge transport layer which contains a charge transport material, the two layers being stacked together on a conductive substrate.

Such an electrophotographic photosensitive member is used to perform an image forming process including the following steps 1)-5):

1) charging a surface of the electrophotographic photosensitive member;

2) exposing the charged surface of the electrophotographic photosensitive member to light to form an electrostatic latent image;

3) developing the electrostatic latent image using toner in the presence of an applied development bias voltage;

4) transferring the formed toner image to a transfer member; and 5) fixing the toner image transferred to the transfer member by heating.

The electrophotographic photosensitive member is rotated for use during such an image forming process. Therefore, a phenomenon occurs that the potential (light potential) of a portion which has been exposed during image formation remains, and therefore, even after the charging step in the next turn of the photosensitive member, a desired charge potential (dark potential) cannot be obtained at the portion which has been exposed in the previous turn. This phenomenon is called "transfer memory." Portions with and without transfer memory have different image densities, and therefore, it is difficult to obtain a satisfactory image.

There are two different types of monolayer electrophotographic photosensitive members, i.e., positively chargeable type and negatively chargeable type. There are also two different types of techniques of charging the electrophotographic photosensitive member, i.e., contact charging and non-contact charging. In the positively chargeable monolayer electrophotographic photosensitive member, when the surface of the electrophotographic photosensitive member is charged, substantially no oxidizing gas such as ozone occurs, which adversely affects the life of the electrophotographic photosensitive member or the office environment. Therefore, the positively chargeable monolayer electrophotographic photosensitive member is preferably used. The positively chargeable monolayer electrophotographic photosensitive member is more preferably used in combination with a contact-charging charger. However, when the contact-charging charger and the positively chargeable monolayer electrophotographic photosensitive member are used in combination, transfer memory is particularly likely to occur.

Under the above circumstances, there is a demand for a positively chargeable monolayer electrophotographic photosensitive member which can reduce or prevent the occurrence of transfer memory during image formation. The use of a charge transport material having excellent charge transport performance is effective in reducing or preventing the occurrence of transfer memory. As charge transport materials having excellent charge transport performance, a variety of triarylamine derivatives, which are hole transport materials, have been proposed. Specific examples of a suitable triarylamine derivative as a hole transport material include the following compounds (HTM-A and HTM-B):

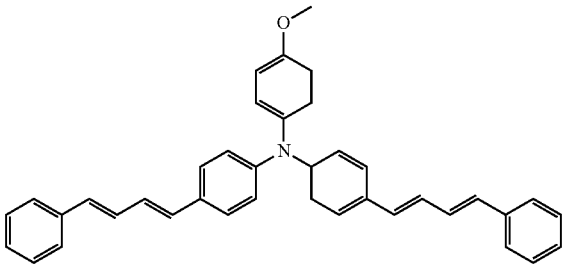

HTM-A

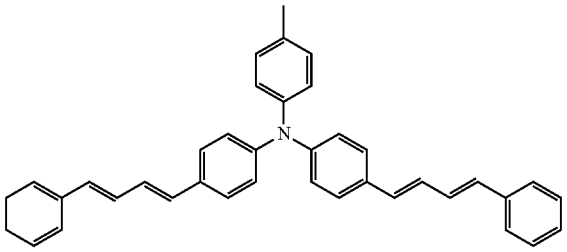

HTM-B

SUMMARY

The present disclosure provides the following.

A positively chargeable monolayer electrophotographic photosensitive member according to a first aspect of the present disclosure includes a photosensitive layer provided on a conductive substrate and having a monolayer structure containing at least a charge generating material, a hole transport material, an electron transport material, and a binder resin.

The hole transport material contains a triarylamine derivative represented by a following formula (1):

(1)

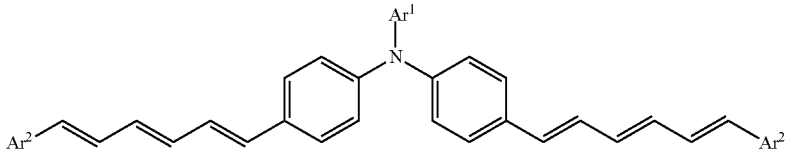

where $Ar^1$ is an aryl group, or a heterocyclic group having a conjugated double bond, $Ar^2$ is an aryl group, and $Ar^1$ and $Ar^2$ are optionally substituted by one or more groups selected from the group consisting of alkyl group having 1-6 carbon atoms, alkoxy group having 1-6 carbon atoms, and phenoxy group. The electron transport material contains at least one compound selected from the group consisting of compounds represented by following formulas (2)-(4):

(2)

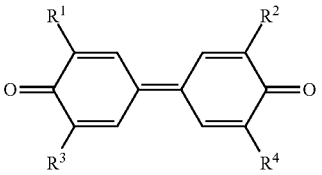

(3)

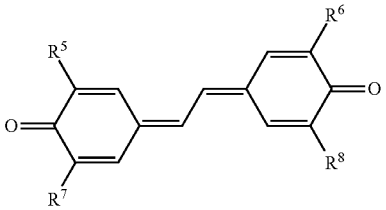

(4)

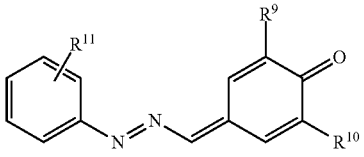

where each of $R^1$-$R^{10}$ is independently a group selected from the group consisting of hydrogen atom, optionally substituted alkyl group, optionally substituted alkenyl group, optionally substituted alkoxy group, optionally substituted aralkyl group, optionally substituted aromatic hydrocarbon group, and optionally substituted heterocyclic group, and $R^{11}$ is a group selected from the group consisting of halogen atom, hydrogen atom, optionally substituted alkyl group, optionally substituted alkenyl group, optionally substituted alkoxy group, optionally substituted aralkyl group, optionally substituted aromatic hydrocarbon group, and optionally substituted heterocyclic group.

An image forming apparatus according to a second aspect of the present disclosure includes an image bearing member (the positively chargeable monolayer electrophotographic photosensitive member of the first aspect), a charger configured to charge a surface of the image bearing member, an exposure unit configured to expose the charged surface of the image bearing member to light to form an electrostatic latent image on the surface of the image bearing member, a development unit configured to develop the electrostatic latent image as a toner image, and a transfer unit configured to transfer the toner image from the image bearing member to a transfer member.

DETAILED DESCRIPTION

Embodiments of the present disclosure will now be described in detail. The present disclosure is not intended to be limited to the embodiments set forth herein, but on the contrary, it is intended to cover such alternatives, modifications, and equivalents as can be reasonably included within the spirit and scope of the present disclosure. Note that the same or like parts may not be redundantly described, but this is not intended to limit the subject matter of the present disclosure.

First Embodiment

A first embodiment is directed to a positively chargeable monolayer electrophotographic photosensitive member (hereinafter also referred to as a "monolayer photosensitive member" or a "photosensitive member") in which a photosensitive layer having a monolayer structure is formed on a conductive substrate. The photosensitive layer contains at least a charge generating material, a hole transport material, an electron transport material, and a binder resin. The hole transport material contains a triarylamine derivative represented by the above formula (1). The electron transport material contains at least one compound selected from the group consisting of the compounds represented by the above formulas (2)-(4).

Figure 1A:
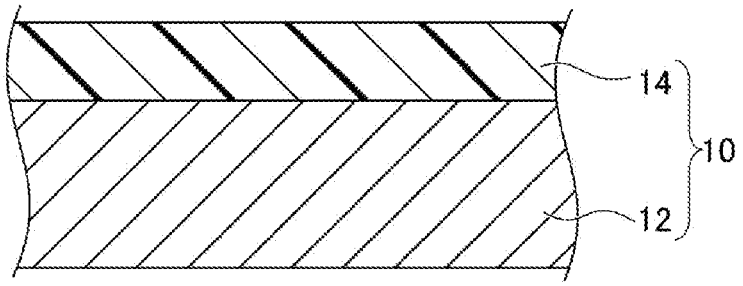
FIG. 1A is a diagram showing a configuration of a positively chargeable monolayer electrophotographic photosensitive member.
Figure 1B:
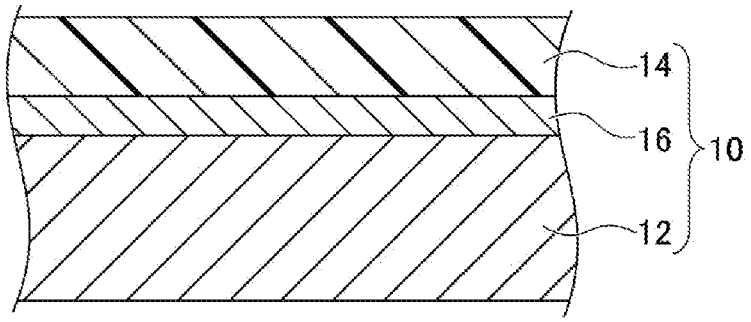
FIG. 1B is a diagram showing a configuration of a positively chargeable monolayer electrophotographic photosensitive member.
Figure 1C:
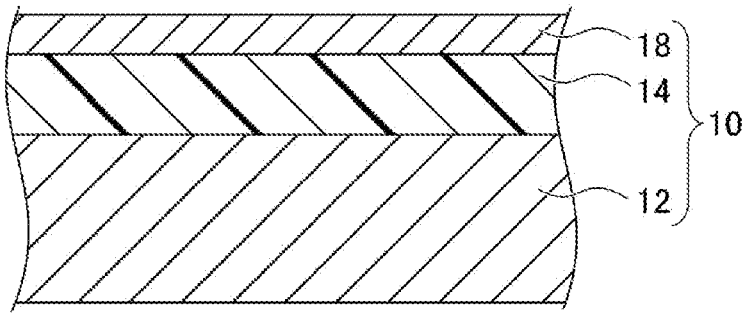
FIG. 1C is a diagram showing a configuration of a positively chargeable monolayer electrophotographic photosensitive member.

As shown in FIGS. 1A and 1B, the positively chargeable monolayer electrophotographic photosensitive member 10 (hereinafter also referred to as a "photosensitive member 10") of the first embodiment includes a conductive substrate 12, and a monolayer photosensitive layer 14 formed on the conductive substrate 12. The photosensitive layer 14 contains a charge generating material, a hole transport material, an electron transport material, and a binder resin. The photosensitive member 10 is not particularly limited as long as the photosensitive member includes the conductive substrate 12 and the photosensitive layer 14. Specifically, for example, as shown in FIG. 1A, the photosensitive layer 14 may be provided directly on the conductive substrate 12. Alternatively, as shown in FIG. 1B, the photosensitive member 10 may include a middle layer 16 between the conductive substrate 12 and the photosensitive layer 14. As shown in FIGS. 1A and 1B, the photosensitive layer 14 may be an outermost layer which is exposed. Alternatively, as shown in FIG. 1C, the photosensitive member 10 may include a protective layer 18 on the photosensitive layer 14.

The conductive substrate and the photosensitive layer will now be successively described.

Conductive Substrate

The conductive substrate is not particularly limited as long as the conductive substrate can be used as the conductive substrate of the photosensitive member. Specifically, for example, the conductive substrate may be one in which at least a surface portion thereof is formed of a conductive material. In other words, specifically, for example, the conductive substrate may be formed of a conductive material. Alternatively, the conductive substrate may be one in which a surface of a plastic material is covered with a conductive material. Examples of the conductive material include aluminum, iron, copper, tin, platinum, silver, vanadium, molybdenum, chromium, cadmium, titanium, nickel, palladium, indium, stainless steel, and brass. The conductive materials may be used alone or in combination as, for example, an alloy etc. In particular, the conductive substrate is preferably formed of aluminum or an aluminum alloy. The use of the conductive substrate formed of aluminum or an aluminum alloy allows for a photosensitive member which can form a more suitable image. This may be because charge is satisfactorily moved from the photosensitive layer to the conductive substrate.

A shape of the conductive substrate may be suitably selected based on the structure of an image forming apparatus which is used. The conductive substrate may be suitably used in the shape of, for example, a sheet or a drum. A thickness of the conductive substrate may be suitably selected based on the shape.

Photosensitive Layer

The photosensitive layer included in the photosensitive member has a monolayer structure containing at least a charge generating material, a hole transport material, an electron transport material, and a binder resin. The hole transport material contained in the photosensitive layer having the monolayer structure contains a triarylamine derivative represented by the following formula (1):

(1)

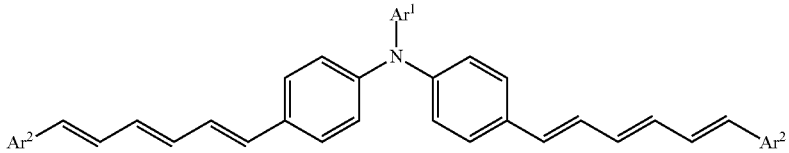

where $Ar^1$ is an aryl group, or a heterocyclic group having a conjugated double bond, and $Ar^2$ is an aryl group. $Ar^1$ and $Ar^2$ are optionally substituted by one or more groups selected from the group consisting of alkyl group having 1-6 carbon atoms, alkoxy group having 1-6 carbon atoms, and phenoxy group.

The electron transport material contained in the photosensitive layer having the monolayer structure contains at least one compound selected from the group consisting of compounds represented by the following formulas (2)-(4):

(2)

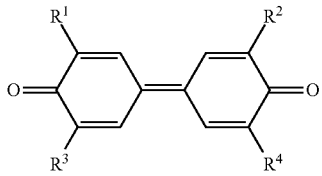

(3)

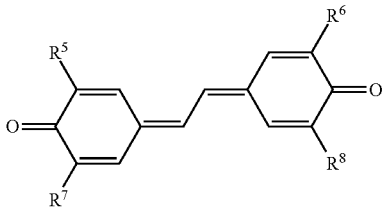

(4)

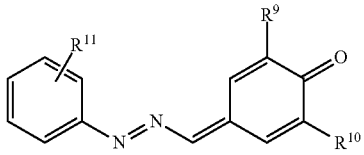

where each of $R^1$-$R^{10}$ is independently a group selected from the group consisting of hydrogen atom, optionally substituted alkyl group, optionally substituted alkenyl group, optionally substituted alkoxy group, optionally substituted aralkyl group, optionally substituted aromatic hydrocarbon group, and optionally substituted heterocyclic group, and $R^{11}$ is a group selected from the group consisting of halogen atom, hydrogen atom, optionally substituted alkyl group, optionally substituted alkenyl group, optionally substituted alkoxy group, optionally substituted aralkyl group, optionally substituted aromatic hydrocarbon group, and optionally substituted heterocyclic group.

The photosensitive layer of the photosensitive member of the first embodiment contains a triarylamine derivative represented by the formula (1) and a quinone compound represented by any of the formulas (2)-(4) among charge transport materials having excellent charge transport performance. Therefore, the occurrence of transfer memory in the transferring step of the image forming process can be reduced or prevented. Transfer memory occurring in the image forming process will now be described.

The image forming process employing an electrophotographic technique typically includes a charging step, an exposing step, a developing step, a transferring step, and a charge neutralizing step. In the charging step, which is the first step, a surface of the photosensitive member which is a surface of the image bearing member is uniformly charged to a predetermined potential to have positive charge. Next, in the exposing step, the surface of the photosensitive member chargeable to the predetermined potential is exposed to light. As a result, an electrostatic latent image is formed.

In the developing step, charged toner is applied to the exposed portion. As a result, a toner image is formed to visualize the electrostatic latent image. Thereafter, in the transferring step, the toner image formed on the surface of the photosensitive member is transferred to an intermediate transfer member. Here, in the step of transferring the toner image to the intermediate transfer member, a bias having a negative polarity opposite to the polarity of the charge of the photosensitive member is applied to the intermediate transfer member.

When the negative bias is applied to the intermediate transfer member, the exposed portion has, on the surface thereof, the toner which forms the toner image. Therefore, the exposed portion holds the same polarity (positive polarity) as during the charging step, even in the presence of the applied negative bias. However, the unexposed portion does not have, on the surface thereof, the toner which forms the toner image. Therefore, the negative bias causes the unexposed portion to have charge having a polarity (negative polarity) which is opposite to that which was during the charging step. As a result, the exposed and unexposed portions of the photosensitive member have potentials having different polarities. This potential difference causes transfer memory during subsequent image formation.

Therefore, in the present disclosure, the photosensitive layer contains a combination of a triarylamine derivative represented by the formula (1) and a quinone compound represented by any of the formulas (2)-(4). As a result, the potential difference which occurs due to the negative charge of the unexposed portion is reduced or eliminated, and therefore, the occurrence of transfer memory in the transferring step is reduced or prevented.

Components (the charge generating material, the hole transport material, the electron transport material, the binder resin, and an additive) contained in the photosensitive layer, and methods for producing the positively chargeable monolayer electrophotographic photosensitive member, will now be described.

Charge Generating Material

The charge generating material is not particularly limited as long as the charge generating material is suitable for the photosensitive member. Specifically, preferable examples of the charge generating material include X-form metal-free phthalocyanine (x-$H_2$Pc) represented by a formula (I) below, α-form or Y-form oxotitanyl phthalocyanine (TiOPc) represented by a formula (II) below, perylene pigments, bis-azo pigments, dithioketopyrrolopyrrole pigments, metal-free naphthalocyanine pigments, metal naphthalocyanine pigments, squaraine pigments, tris-azo pigments, indigo pigments, azulenium pigments, cyanine pigments, powders of inorganic photoconductive materials (e.g., selenium, selenium-tellurium, selenium-arsenic, cadmium sulfide, and amorphous silicon), pyrylium salts, anthanthrone-based pigments, triphenylmethane-based pigments, threne-based pigments, toluidine-based pigments, pyrazoline-based pigments, and quinacridone-based pigments. Of these charge generating materials, X-form metal-free phthalocyanine and α-form or Y-form oxotitanyl phthalocyanine are preferable.

(I)

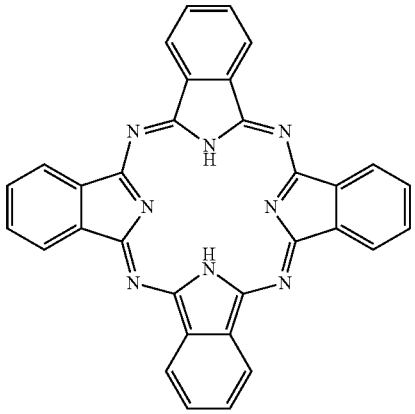

(II)

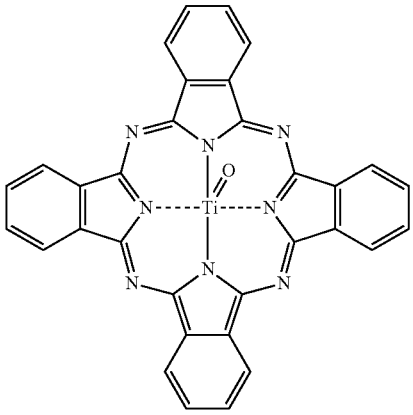

In order to improve the sensitivity, it is preferable to use the following oxotitanyl phthalocyanine as the charge generating material:

an oxotitanyl phthalocyanine having the following properties: (A) in CuKα characteristic X-ray diffraction spectrum, there is a main peak at a Bragg angle of 2θ±0.2°=27.2°; and (B) in differential scanning calorimetry, there is one peak within the range of 50-270° C. in addition to peaks caused by vaporization of adsorbed water;

an oxotitanyl phthalocyanine having the following properties: in addition to (A), (C) in differential scanning calorimetry, there is no peak within the range of 50-400° C. other than peaks caused by vaporization of adsorbed water; and an oxotitanyl phthalocyanine having the following properties: in addition to (A), (D) in differential scanning calorimetry, there is no peak within the range of 50-270° C. other than peaks caused by vaporization of adsorbed water, and there is one peak within the range of 270-400° C.

The charge generating materials may be used alone or in combination so that there is an absorption wavelength in a desired region. Of the above-mentioned charge generating materials, it is preferable to use a photosensitive member having sensitivity in the wavelength range of at least 700 nm, particularly in an image forming apparatus employing a digital optical system. An example of the image forming apparatus employing a digital optical system is a laser printer or fax machine which employs a semiconductor laser light source. As the charge generating material, for example, a phthalocyanine-based pigment, such as metal-free phthalocyanine or oxotitanyl phthalocyanine, is preferably used. Note that any crystal form of the phthalocyanine-based pigment is not particularly limited. For image forming apparatuses employing an analog optical system, such as an electrostatic photocopier using a white light source (e.g., a halogen lamp), a photosensitive member having sensitivity in a visible range is required. Therefore, as the charge generating material, for example, a perylene pigment or a bis-azo pigment is suitably used.

Hole Transport Material

The hole transport material is not particularly limited as long as the hole transport material contains a triarylamine derivative represented by a formula (1) below. The triarylamine derivative represented by the following formula (1) will now be described:

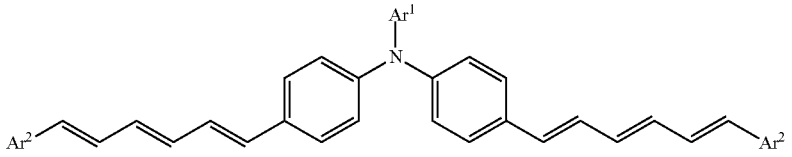

(1)

where $Ar^1$ is an aryl group, or a heterocyclic group having a conjugated double bond, and $Ar^2$ is an aryl group. $Ar^1$ and $Ar^2$ are optionally substituted by one or more groups selected from the group consisting of alkyl group having 1-6 carbon atoms, alkoxy group having 1-6 carbon atoms, and phenoxy group.

In the formula (1), when $Ar^1$ and $Ar^2$ are each an aryl group, the aryl group is preferably a phenyl group, or a group which is formed by two or three benzene rings being fused by condensation or linked together by single bonds. The number of benzene rings contained in the aryl group is 1-3, preferably 1 or 2. When $Ar^1$ and $Ar^2$ are each an aryl group, specific examples of the aryl group include phenyl group, naphthyl group, biphenylyl group, anthryl group, or phenanthryl group.

In the formula (1), when $Ar^1$ is a "heterocyclic group having a conjugated double bond," the heterocyclic group is a 5- or 6-membered monocyclic ring containing one or more N, S, and O atoms, or a heterocyclic group in which the monocyclic rings, or the monocyclic ring and a benzene ring, are fused by condensation, where the ring linked to a nitrogen atom to which $Ar^1$ is linked has a conjugated double bond. When $Ar^1$ is a heterocyclic group which is a fused ring, one of the monocyclic rings contained in the fused ring that is bonded to the nitrogen atom to which $Ar^1$ is linked may have a conjugated double bond. When the heterocyclic group is a fused ring, the number of rings is not more than three.

When $Ar^1$ is a heterocyclic group having a conjugated double bond, examples of a heterocyclic ring contained in the heterocyclic group include thiophene, furan, pyrrole, imidazole, pyrazole, isothiazole, isoxazole, pyridine, pyrazine, pyrimidine, pyridazine, triazole, tetrazole, indole, 1H-indazole, purine, 4H-quinolizine, isoquinoline, quinoline, phthalazine, naphthyridine, quinoxaline, quinazoline, cinnoline, pteridine, benzofuran, 1,3-benzodioxole, benzoxazole, benzothiazole, benzimidazole, benzimidazolone, and phthalimide.

$Ar^1$ and $Ar^2$ are each optionally substituted by one or more groups selected from the group consisting of alkyl group having 1-6 carbon atoms, alkoxy group having 1-6 carbon atoms, and phenoxy group. Specific examples of the alkyl group having 1-6 carbon atoms include methyl group, ethyl group, n-propyl group, iso-propyl group, n-butyl group, sec-butyl group, tert-butyl group, n-pentyl group, iso-pentyl group, tert-pentyl group, neopentyl group, n-hexyl group, and iso-hexyl group. Specific examples of the alkoxy group having 1-6 carbon atoms include methoxy group, ethoxy group, n-propyloxy group, iso-propyloxy group, n-butyloxy group, sec-butyloxy group, tert-butyloxy group, n-pentyloxy group, iso-pentyloxy group, tert-pentyloxy group, neopentyloxy group, n-hexyloxy group, and iso-hexyloxy group.

When $Ar^1$ and $Ar^2$ each have substituents at adjacent positions thereon, the substituents may be linked together to form a fused ring. When the adjacent substituents form a fused ring, the fused ring is preferably a 5- or 6-membered ring.

In the formula (1), the two $Ar^2$s may be the same or different. In the compound represented by the formula (1), the two $Ar^2$s are preferably the same group. In this case, the process of producing the triarylamine derivative can be simplified, whereby triarylamine can be produced at low cost.

Of the triarylamine derivatives represented by the formula (1), specific examples of a suitable compound include the following HTM-1-HTM-10:

HTM-1
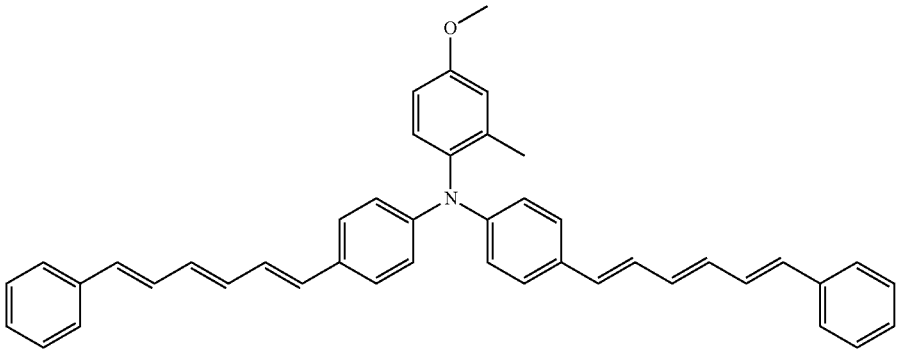
HTM-2
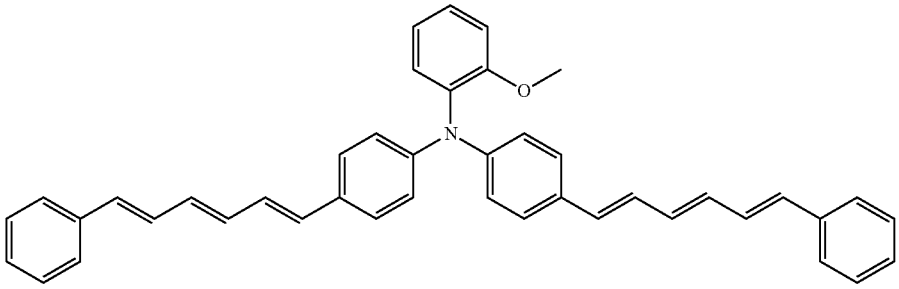
HTM-3
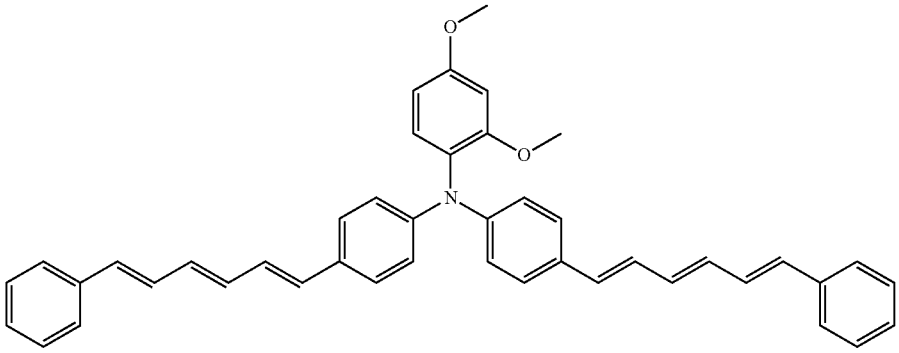
HTM-4
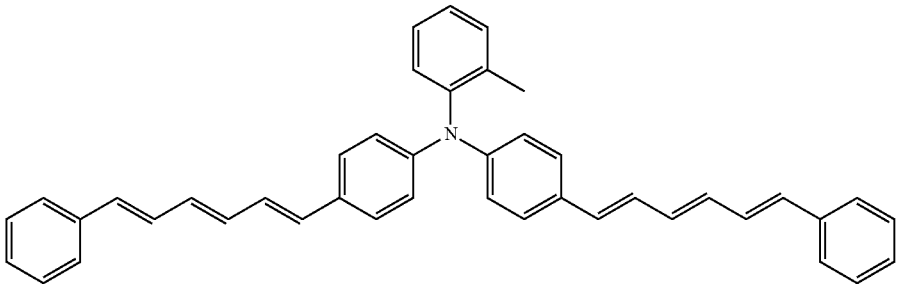
HTM-5
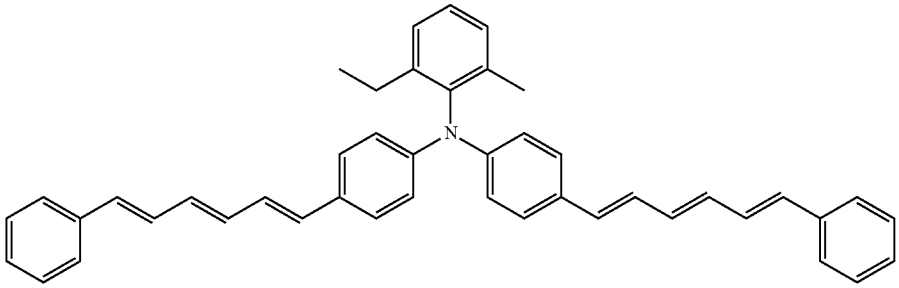

-continued
HTM-6
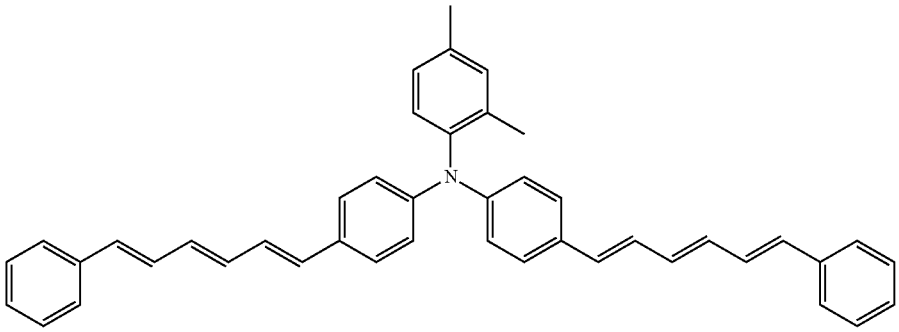
HTM-7
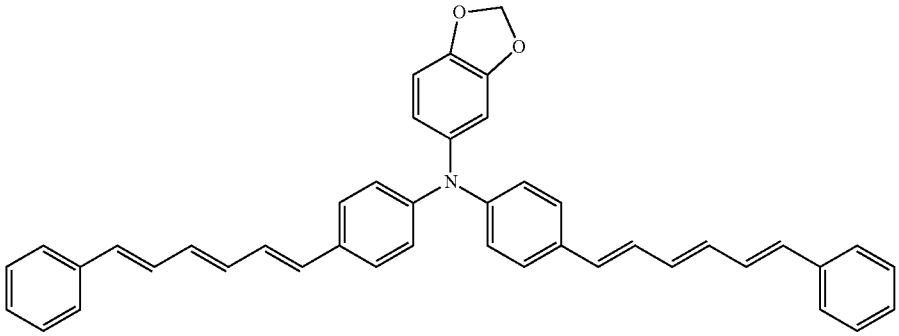
HTM-8
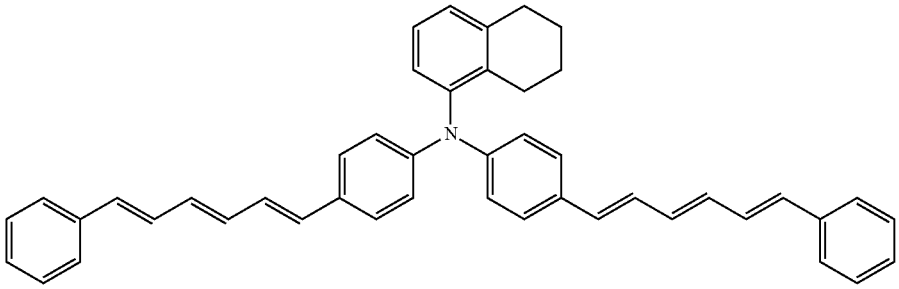
HTM-9
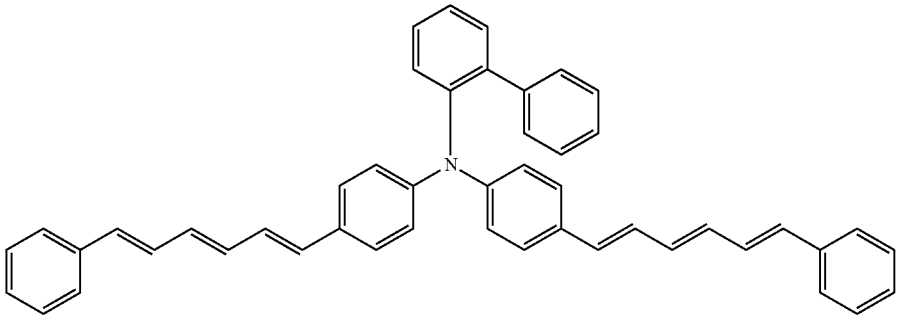

-continued

HTM-10

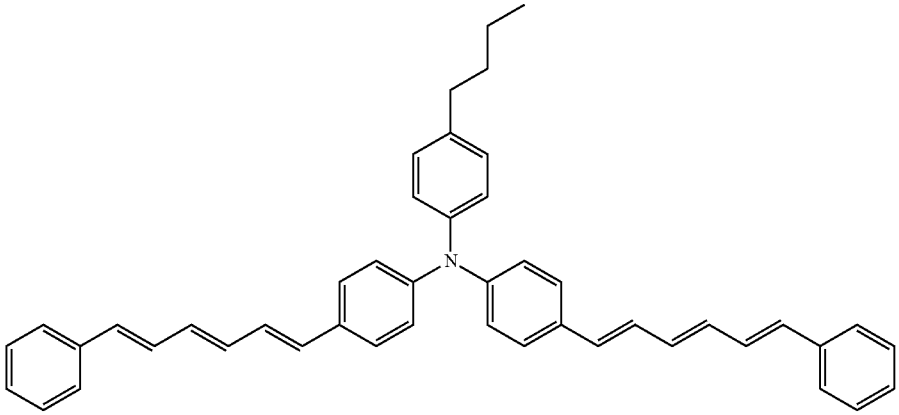

A method for producing the triarylamine derivative represented by the formula (1) is not particularly limited. An example suitable method for producing the triarylamine derivative represented by the formula (1) is the following one including steps A-C.

Step A

Step A is the step in which a compound represented by a formula (6) and triethyl phosphite are caused to react to produce a compound represented by a formula (7). Step A is represented by a reaction formula below. Note that, in the compound represented by the formula (6), $Ar^2$ is the same as $Ar^2$ of the compound represented by the formula (1). $X^1$ is a halogen atom. $X^1$ is preferably chlorine or bromine because they have excellent reactivity with triethyl phosphite.

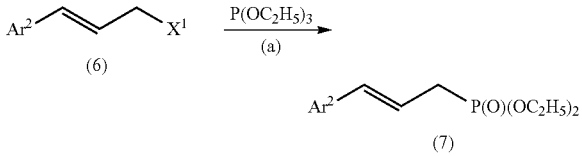

The amount of triethyl phosphite which is used to react with the compound represented by the formula (6) in the reaction of step A is not particularly limited as long as the amount allows the reaction of step A to proceed satisfactorily. The molar amount of triethyl phosphite is preferably at least equal to and not more than 2.5 times the molar amount of the compound represented by the formula (6). If the amount of triethyl phosphite is excessively small, the compound represented by the formula (7) is likely to be contaminated by the unreacted compound represented by the formula (6), leading to an increase in burden of purification. If the amount of triethyl phosphite is excessively large, the production cost of the compound represented by the formula (7) increases.

The reaction temperature of step A is not particularly limited as long as the temperature allows the reaction of step A to proceed satisfactorily. The reaction temperature of step A is preferably at least 160° C. and not more than 200° C. The reaction time of step A is at least 2 hours and not more than 6 hours.

Step B

Step B is the step in which the compound represented by the formula (7) which has been obtained in step A, and 3-(4-halophenyl)acrylaldehyde represented by a formula (8), are caused to react to produce a compound represented by a formula (9). Step B is represented by a reaction formula below. Note that, in the formula (8), $X^2$ is a halogen atom. $X^2$ is preferably chlorine or bromine because they have excellent reactivity in step C described below.

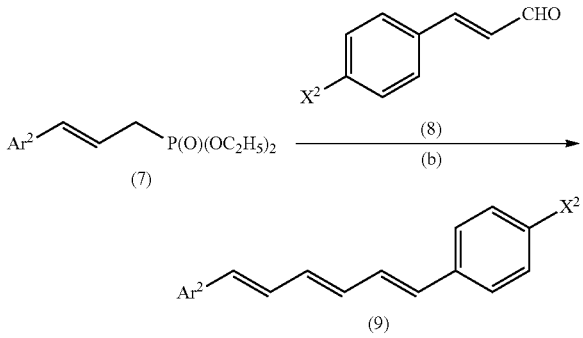

The amount of the compound represented by the formula (8) which is used to react with the compound represented by the formula (7) in the reaction of step B is not particularly limited as long as the amount allows the reaction of step B to proceed satisfactorily. The molar amount of the compound represented by the formula (8) is preferably at least equal to and not more than 2.5 times the molar amount of the compound represented by the formula (7).

The reaction temperature of step B is not particularly limited as long as the temperature allows the reaction of step B to proceed satisfactorily. The reaction temperature of step B is preferably at least −20° C. and not more than 30° C. The reaction time of step B is at least 5 hours and not more than 30 hours.

The reaction of step B is caused to proceed in the presence of a base. Examples of the base which is suitably used in step B include: alkali metal alkoxides such as sodium methoxide and sodium ethoxide; alkali metal hydrides such as sodium hydride and potassium hydride; and alkyl lithium such as n-butyllithium. These bases may be used in combination.

The molar amount of the base used in step B is preferably at least equal to and not more than 1.5 times the molar amount of the compound represented by the formula (8). If the molar amount of the base is smaller than the molar amount of the compound represented by the formula (8), the reactivity in the reaction of step B may significantly decrease. If the molar amount of the base is more than 1.5 times the molar amount of the compound represented by the formula (8), it may be difficult to control the reaction of step B.

A solvent used in step B is not particularly limited as long as the solvent is inert to the reaction of step B. Specific examples of the solvent which is suitably used in step B include: ethers such as diethyl ether, tetrahydrofuran, and 1,4-dioxane; halogenated hydrocarbons such as methylene chloride, chloroform, and dichloroethane; aromatic hydrocarbons such as benzene, toluene, xylene, and ethylbenzene; and dimethylformamide.

Step C

Step C is the step in which one mole of an amine represented by a formula (10), and two moles of the compound represented by the formula (9), are caused to react to produce a triarylamine derivative represented by the formula (1). Step C is represented by a reaction formula below. Note that, in the formula (10), $Ar^1$ is the same as $Ar^1$ of the compound that is represented by the formula (1).

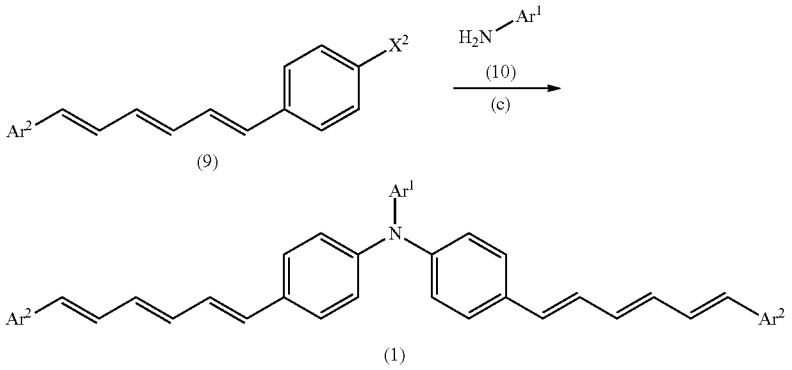

The amount of the compound represented by the formula (10) which is used to react with the compound represented by the formula (9) in the reaction of step C is not particularly limited as long as the amount allows the reaction of step C to proceed satisfactorily. The molar amount of the compound represented by the formula (9) is preferably at least two times and not more than 5 times the molar amount of the compound represented by the formula (10).

The reaction temperature of step C is not particularly limited as long as the temperature allows the reaction of step C to proceed satisfactorily. The reaction temperature of step C is preferably at least 80° C. and not more than 140° C. The reaction time of step B is at least 2 hours and not more than 10 hours.

The reaction of step C is preferably caused to proceed in the presence of a palladium catalyst and a base. In this case, halogenated hydrogen occurring in the reaction liquid is quickly neutralized. Therefore, the activity of the catalyst is enhanced, so that the palladium catalyst can satisfactorily reduce the activation energy of the reaction of step C. Therefore, the use of a palladium catalyst and a base allows the triarylamine derivative represented by the formula (1) to be produced in a particularly satisfactorily yield.

Specific examples of a palladium compound which can be suitably used as a palladium catalyst includes: tetravalent palladium compounds such as sodium hexachloropalladate (IV) tetrahydrate and potassium hexachloropalladate (IV) tetrahydrate; divalent palladium compounds such as palladium (II) chloride, palladium (II) bromide, palladium (II) acetate, palladium (II) acetylacetate, dichlorobis(benzonitrile)palladium (II), dichlorobis(triphenylphosphine)palladium (II), dichlorotetramine palladium (II), and dichloro(cycloocta-1,5-diene)palladium (II); and palladium compounds such as tris(dibenzylideneacetone)dipalladium (0), tris(dibenzylideneacetone)dipalladium chloroform complex (0), and tetrakis (triphenylphosphine)palladium (0). The palladium catalysts may be used in combination.

The amount of the palladium catalyst which is used is not particularly limited as long as the amount of use allows the reaction of step C to proceed satisfactorily, and is preferably at least 0.00025 moles and not more than 20 moles per mole of the amine represented by the formula (10), more preferably at least 0.0005 moles and not more than 10 moles.

The base used in the reaction of step C is not particularly limited as long as the base allows the reaction to proceed satisfactorily, and may be either inorganic or organic. Specific examples of a base which is suitably used in the reaction of step C include alkali metal alkoxides such as sodium methoxide, sodium ethoxide, potassium methoxide, potassium ethoxide, lithium-tert-butoxide, sodium-tert-butoxide, and potassium-tert-butoxide. Of the alkali metal alkoxides, sodium-tert-butoxide is particularly preferable. Inorganic bases, such as tripotassium phosphate and cesium fluoride, may be suitably used.

For example, when 0.005 moles of the palladium compound is added per mole of the amine represented by the formula (10), the amount of the base used in the reaction of step C is preferably at least 0.995 moles and not more than 5 moles, more preferably at least 1 mole and not more than 5 moles, although it depends on the amount of the palladium catalyst which is used.

The solvent used in step C is not particularly limited as long as the solvent is inert in the reaction of step C. Specific examples of a suitable solvent include aromatic hydrocarbons such as benzene, toluene, xylene, and ethylbenzene.

Note that a triarylamine derivative represented by the formula (1) where the two $Ar^2$s are different and asymmetrical groups, can be produced by causing the reaction in step C of an amine represented by the formula (10) and a compound represented by the formula (9) in two separate stages. Specifically, in the first stage, an amine represented by the formula (10) and a compound represented by the formula (9) may be caused to react to produce a diarylamine derivative. Next, in the second stage, the diarylamine derivative obtained in the first stage and a compound represented by the formula (9) which is different from that which was used in the first stage may be caused to react. As a result, an asymmetrical triarylamine derivative can be produced.

The hole transport material may contain another hole transport material(s) in addition to the triarylamine derivative represented by the formula (1) as long as the advantageous effects of the present disclosure are not adversely affected. Specific examples of such a hole transport material other than the triarylamine derivative represented by the formula (1) include benzidine derivatives; oxadiazole-based compounds such as 2,5-di(4-methylaminophenyl)-1,3,4-oxadiazole; styryl-based compounds such as 9-(4-diethylaminostyryl)anthracene; carbazole-based compounds such as polyvinylcarbazole; organic polysilane compounds; pyrazoline-based compounds such as 1-phenyl-3-(p-dimethylaminophenyl) pyrazoline; nitrogen-containing cyclic and fused polycyclic compounds such as hydrazone-based compounds, triarylamine-based compounds other than the triarylamine derivative represented by the formula (1), indole-based compounds, oxazole-based compounds, isoxazole-based compounds, thiazole-based compounds, and triazole-based compounds. These hole transport materials may be used alone or in combination.

When the hole transport material contains a triarylamine derivative represented by the formula (1), and a hole transport material other than triarylamine derivative represented by the formula (1), the content of the triarylamine derivatives represented by the formula (1) in the hole transport material is preferably at least 80% by mass, more preferably at least 90% by mass, and particularly preferably 100% by mass.

Electron Transport Material

The electron transport material contains at least one selected from the group consisting of compounds represented by the following formulas (2)-(4):

(2)

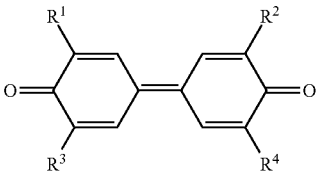

(3)

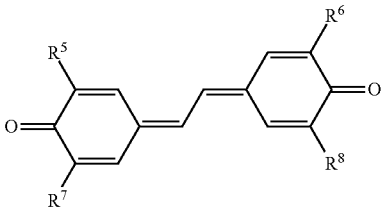

(4)

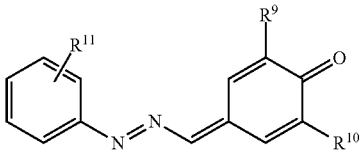

where each of $R^1$-$R^{10}$ is independently a group selected from the group consisting of hydrogen atom, optionally substituted alkyl group, optionally substituted alkenyl group, optionally substituted alkoxy group, optionally substituted aralkyl group, optionally substituted aromatic hydrocarbon group, and optionally substituted heterocyclic group, and $R^{11}$ is a group selected from the group consisting of halogen atom, hydrogen atom, optionally substituted alkyl group, optionally substituted alkenyl group, optionally substituted alkoxy group, optionally substituted aralkyl group, optionally substituted aromatic hydrocarbon group, and optionally substituted heterocyclic group.

When $R^1$-$R^{10}$ are each an optionally substituted alkyl group, the number of carbon atoms in the alkyl group is not particularly limited as long as the number does not adversely affect the advantageous effects of the present disclosure. The number of carbon atoms in the alkyl group is preferably 1-10, more preferably 1-6, and particularly preferably 1-4. The structure of the alkyl group may be straight chain, branched or cyclic, or combinations thereof. Examples of a substituent which may be present on the alkyl group include halogen atom, hydroxy group, alkoxy group having 1-4 carbon atoms, and cyano group. The number of substituents that may be present on the alkyl group is not particularly limited as long as the number does not adversely affect the advantageous effects of the present disclosure. The number of substituents that may be present on the alkyl group is preferably not more than three.

Specific examples of the optionally substituted alkyl group include methyl group, ethyl group, n-propyl group, isopropyl group, cyclopropyl group, n-butyl group, isobutyl group, sec-butyl group, tert-butyl group, cyclobutyl group, n-pentyl group, cyclopentyl group, n-hexyl group, cyclohexyl group, n-heptyl group, n-octyl group, n-nonyl group, n-decyl group, chloromethyl group, dichloromethyl group, trichloromethyl group, cyanomethyl group, hydroxymethyl group, and hydroxyethyl group. Of these groups, methyl group, ethyl group, n-propyl group, isopropyl group, n-butyl group, isobutyl group, sec-butyl group, and tert-butyl group are preferable, more preferably methyl group and ethyl group, and particularly preferably methyl group.

When $R^1$-$R^{10}$ are each an optionally substituted alkenyl group, the number of carbon atoms in the alkenyl group is not particularly limited as long as the number does not adversely affect the advantageous effects of the present disclosure. The number of carbon atoms in the alkyl group is preferably 2-10, more preferably 2-6, and particularly preferably 2-4. The structure of the alkyl group may be straight chain, branched, cyclic, or any combination thereof. Examples of a substituent that may be present on the alkenyl group include halogen atom, hydroxy group, alkoxy group having carbon atoms 1-4, and cyano group. The number of substituents that may be present on the alkenyl group is not particularly limited as long as the number does not adversely affect the advantageous effects of the present disclosure. The number of substituents that may be present on the alkenyl group is preferably not more than three.

Specific examples of the optionally substituted alkenyl group include vinyl group, 1-propenyl group, 2-propenyl (allyl) group, 1-butenyl group, 2-butenyl group, 3-butenyl group, 2-cyanovinyl group, 2-chlorovinyl group, and 3-chloroallyl group. Of these groups, vinyl group and 2-propenyl (allyl) are preferable group.

When $R^1$-$R^{10}$ are each an optionally substituted alkoxy group, the number of carbon atoms in the alkoxy group is not particularly limited as long as the number does not adversely affect the advantageous effects of the present disclosure. The number of carbon atoms in the alkoxy group is preferably 1-10, more preferably 1-6, and particularly preferably 1-4. The structure of the alkoxy group may be straight chain, branched or cyclic, or combinations thereof. Examples of a substituent that may be present on the alkoxy group include halogen atom, hydroxy group, alkoxy group having 1-4 carbon atoms, and cyano group. The number of substituents that may be present on the alkoxy group is not particularly limited as long as the number does not adversely affect the advantageous effects of the present disclosure. The number of substituents that may be present on the alkoxy group is preferably not more than three.

Specific examples of the optionally substituted alkoxy group include methoxy group, ethoxy group, n-propyloxy group, cyclopropyloxy group, isopropyloxy group, n-butyloxy group, isobutyloxy group, sec-butyloxy group, tert-butyloxy group, cyclobutyloxy group, n-pentyloxy group, cyclopentyloxy group, n-hexyloxy group, cyclohexyloxy group, n-heptyloxy group, n-octyloxy group, n-nonyloxy group, n-decyloxy group, chloromethyloxy group, dichloromethyloxy group, trichloromethyloxy group, cyanomethyloxy group, hydroxymethyloxy group, and hydroxyethyloxy group. Of these groups, methoxy group, ethoxy group, n-propyloxy group, isopropyloxy group, n-butyloxy group, isobutyloxy group, sec-butyloxy group, and tert-butyloxy group are preferable, more preferably methoxy group and ethoxy group, and particularly preferably methox group.

When $R^1$-$R^{10}$ are each an optionally substituted aralkyl group, the number of carbon atoms in the aralkyl group is not particularly limited as long as the number does not adversely affect the advantageous effects of the present disclosure. The number of carbon atoms in the aralkyl group is preferably at least 1 and not more than 15, more preferably at least 1 and not more than 13, and particularly preferably at least 1 and not more than 12. Examples of a substituent that may be present on the aralkyl group include halogen atom, hydroxy group, alkyl group having at least 1 and not more than 4 carbon atoms, alkoxy group having at least 1 and not more than 4 carbon atoms, nitro group, cyano group, aliphatic acyl group having at least 2 and not more than 4 carbon atoms, benzoyl group, phenoxy group, alkoxycarbony group containing alkoxy group having at least 1 and not more than 4 carbon atoms, and phenoxycarbonyl group. The number of substituents that may be present on the aralkyl group is not particularly limited as long as the number does not adversely affect the advantageous effects of the present disclosure. The number of substituents that may be present on the aralkyl group is preferably not more than 5, more preferably not more than 3.

Specific examples of the optionally substituted aralkyl group include benzil group, 2-methylbenzil group, 3-methylbenzil group, 4-methylbenzil group, 2-chlorobenzil group, 3-chlorobenzil group, 4-chlorobenzil group, phenethyl group, α-naphthylmethyl group, β-naphthylmethyl group, α-naphthylethyl group, and β-naphthylethyl group. Of these groups, benzil group, phenethyl group, α-naphthylmethyl group, and β-naphthylmethyl group are preferable, more preferably benzyl group and phenethyl group.

When $R^1$-$R^{10}$ are each an optionally substituted aromatic hydrocarbon group, the optionally substituted aromatic hydrocarbon group is not particularly limited as long as the optionally substituted aromatic hydrocarbon group does not adversely affect the advantageous effects of the present disclosure. The aromatic hydrocarbon group may be preferably a phenyl group or a group which is formed by two or three benzene rings fused by condensation or linked together by single bonds. The number of benzene rings in the aromatic hydrocarbon group is at least 1 and not more than 3, preferably 1 or 2. Examples of a substituent that may be present on the aromatic hydrocarbon group include halogen atom, hydroxy group, alkyl group having 1-4 carbon atoms, alkoxy group having 1-4 carbon atoms, nitro group, cyano group, aliphatic acyl group having 2-4 carbon atoms, benzoyl group, phenoxy group, alkoxycarbonyl group containing alkoxy group having 1-4 carbon atoms, and phenoxycarbonyl group.

Specific examples of the optionally substituted aromatic hydrocarbon group include phenyl group, o-tolyl group, m-tolyl group, p-toly group, o-chlorophenyl group, m-chlorophenyl group, p-chlorophenyl group, o-nitrophenyl group, m-nitrophenyl group, p-nitrophenyl group, α-naphthyl group, β-naphthyl group, biphenylyl group, anthryl group, and phenanthryl group. Of these groups, phenyl group, α-naphthyl group, and β-naphthyl group are preferable, more preferably phenyl group.

When $R^1$-$R^{10}$ are each an optionally substituted heterocyclic group, the optionally substituted heterocyclic group is not particularly limited as long as the optionally substituted heterocyclic group does not adversely affect the advantageous effects of the present disclosure. The heterocyclic group is a five- or six-membered monocyclic ring which contains at least one hetero-atom selected from the group consisting of N, S, and O, such monocyclic rings fused together, or such a monocyclic ring fused with a five- or six-membered hydrocarbon ring. When the heterocyclic group is a fused ring, the number of rings contained in the fused ring is preferably not more than three. Examples of a substituent that may be present on the heterocyclic group include halogen atom, hydroxy group, alkyl group having 1-4 carbon atoms, alkoxy group having 1-4 carbon atoms, nitro group, cyano group, aliphatic acyl group having 2-4 carbon atoms, benzoyl group, phenoxy group, alkoxycarbonyl group containing alkoxy group having 1-4 carbon atoms, and phenoxycarbonyl group.

Examples of a suitable heterocyclic ring contained in the optionally substituted heterocyclic group include thiophene, furan, pyrrole, imidazole, pyrazole, isothiazole, isoxazole, pyridine, pyrazine, pyrimidine, pyridazine, triazole, tetrazole, indole, 1H-indazole, purine, 4H-quinolizine, isoquinoline, quinoline, phthalazine, naphthyridine, quinoxaline, quinazoline, cinnoline, pteridine, benzofuran, 1,3-benzodioxole, benzoxazole, benzothiazole, benzimidazole, benzimidazolone, phthalimide, piperidine, piperazine, morpholine, and thiomorpholine.

$R^{11}$ may be hydrogen atom, optionally substituted alkyl group, optionally substituted alkenyl group, optionally substituted alkoxy group, optionally substituted aralkyl group, optionally substituted aromatic hydrocarbon group, or optionally substituted heterocyclic group. In this case, suitable or specific examples of these groups are similar to those of $R^1$-$R^{10}$.

When $R^{11}$ is a halogen atom, examples of the halogen atom include chlorine, bromine, iodine, and fluorine. Of these halogen atoms, chlorine is more preferable.

Specific suitable examples of the electron transport materials represented by the formulas (2)-(4) include compounds represented by the following formulas:

ETM-1

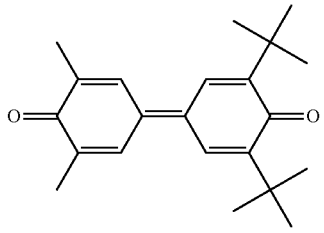

ETM-2

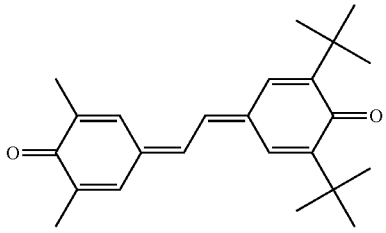

-continued

ETM-3

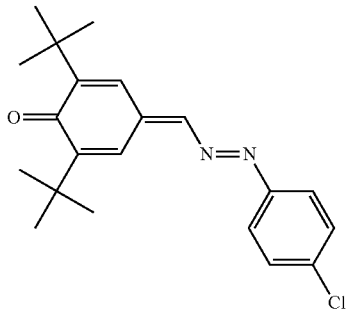

The electron transport material may contain another electron transport material in addition to the compound represented by any of the formulas (2)-(4) as long as the advantageous effects of the present disclosure are not adversely affected. Specific examples of a suitable electron transport material other than the compounds represented by the formulas (2)-(4) include: quinone derivatives such as naphthoquinone derivatives, diphenoquinone derivatives, anthraquinone derivatives, azoquinone derivatives, nitroanthraquinone derivatives, and dinitroanthraquinone derivatives; malononitrile derivatives; thiopyrane derivatives; trinitrothioxanthone derivatives; 3,4,5,7-tetranitro-9-fluorenone derivatives; dinitroanthracene derivatives; dinitroacridine derivatives; tetracyanoethylene; 2,4,8-trinitrothioxanthone; dinitrobenzene; dinitroanthracene; dinitroacridine; succinic anhydride; maleic anhydride; and dibromomaleic anhydride.

When the electron transport material contains another electron transport material in addition to the compound represented by any of the formulas (2)-(4), the content of the compound represented by any of the formulas (2)-(4) in the electron transport material is preferably at least 80% by mass, more preferably at least 90% by mass, and particularly preferably 100% by mass.

The reduction potential of the electron transport material is not particularly limited as long as the value does not adversely affect the advantageous effects of the present disclosure. The reduction potential of the electron transport material is preferably at least −1.05 V and not more than −0.85 V (vs. $Ag/Ag^+$). When an electron transport material having a reduction potential of at least −1.05 V and not more than −0.85 V is used, transfer memory can be particularly satisfactorily reduced or prevented, and therefore, an image which does not have a defect, such as ghost, can be formed. The reduction potential of the electron transport material may be measured by the following method.

<Method of Measuring Reduction Potential>

The reduction potential is determined by cyclic voltammetry under the following measurement conditions.

Working electrode: glassy carbon

Counter electrode: platinum

Reference electrode: silver/silver nitrate (0.1 mol/L, $AgNO_3$-acetonitrile solution)

Sample solution electrolyte: tetra-n-butylammonium perchlorate (0.1 mol)

Substance to be measured: electron transport material (0.001 mol)

Solvent: dichloromethane (1 L)

The drift mobility of the electron transport material is not particularly limited as long as the value does not adversely affect the advantageous effects of the present disclosure. The drift mobility of the electron transport material is preferably at least $4.5\times10^{-7}$ $cm^2/V\cdot sec$. When the electron transport material having a drift mobility of at least $4.5\times10^{-7}$ $cm^2/V\cdot sec$ is used, transfer memory can be particularly satisfactorily reduced or prevented, and therefore, an image which does not have a defect, such as ghost, can be formed. Note that the drift mobility of the electron transport material is measured using a membrane (thickness: 5 μm) formed of a polycarbonate resin composition containing 30% by mass of the electron transport material and 70% by mass of bisphenol Z polycarbonate resin having a viscosity average molecular weight of 50,000 under the conditions that the temperature is 23° C. and the field intensity is $3.0\times10^5$ V/cm. Specifically, the drift mobility of the electron transport material may be measured by the following method.

<Method of Measuring Drift Mobility>

Bisphenol Z polycarbonate resin having a viscosity average molecular weight of 50,000, and the electron transport material which is 30% by mass of the total mass of the sample, are added to an organic solvent. Thereafter, the polycarbonate resin and the electron transport material are dissolved in the organic solvent to prepare an application liquid. The application liquid thus prepared is applied to a substrate made of aluminum, followed by a thermal treatment at 80° C. for 30 min Thereafter, the solvent is removed to form an applied film having a thickness of 5 μm. Next, a translucent gold electrode is formed on the applied film by a vacuum vapor deposition technique to prepare a measurement sample. The sample thus prepared is used to measure the drift mobility using a time-of-flight (TOF) technique under the conditions that the temperature is 23° C. and the field intensity is $3.0\times10^5$ V/cm.

The viscosity average molecular weight [M] of the polycarbonate resin is measured as follows: the intrinsic viscosity [η] is measured using an Ostwald viscometer; and the viscosity average molecular weight [M] of the polycarbonate resin is calculated from Schnell's formula $[\eta]=1.23\times10^{-4}M^{0.83}$. Note that [η] may be measured using a polycarbonate resin solution. The polycarbonate resin solution is obtained by dissolving the polycarbonate resin in methylene chloride as a solvent to a concentration of 6.0 $g/dm^3$ at a temperature of 20° C.

The molecular weight of the electron transport material is preferably not more than 400. When the electron transport material contains a plurality of compounds, the mass (g) of one mole of the electron transport material is defined as the average molecular weight of the electron transport material.

By using the electron transport material having a reduction potential, a drift mobility, and a molecular weight which fall within the above ranges, the occurrence of transfer memory during image formation can be more effectively reduced or prevented.

Binder Resin

The binder resin is not particularly limited as long as the binder resin can be suitably contained in the photosensitive layer of the photosensitive member. Specific examples of the binder resin which is suitably used include: thermoplastic resins such as polycarbonate resins, styrene-based resins, styrene-butadiene copolymers, styrene-acrylonitrile copolymers, styrene-maleic acid copolymers, styrene-acrylic acid copolymers, acrylic copolymers, polyethylene resins, ethylene-vinyl acetate copolymers, chlorinated polyethylene resins, polyvinyl chloride resins, polypropylene resins, ionomers, vinyl chloride-vinyl acetate copolymers, alkyd resins, polyamide resins, polyurethane resins, polycarbonate resins, polyarylate resins, polysulfone resins, diallyl phthalate resins, ketone resins, polyvinyl butyral resins, polyether resins, and polyester resins; thermosetting resins such as silicone resins, epoxy resins, phenol resins, urea resins, melamine resins, and other crosslinkable thermosetting resins; and photocurable resins such as epoxy acrylate resins and urethane-acrylate copolymer resins. These resins may be used alone or in combination.

Of these resins, polycarbonate resins, such as bisphenol Z polycarbonate resins, bisphenol ZC polycarbonate resins, bisphenol C polycarbonate resins, and bisphenol A polycarbonate resins, are more preferable. When these polycarbonate resins are used, a photosensitive layer having a good balance between workability, mechanical properties, optical properties, and abrasion resistance is obtained. As the polycarbonate resins, resins represented by a formula (5) below are preferable. In the resins represented by the formula (5), resins in which $R^{16}$ and $R^{17}$ in the formula (5) are bonded together to form a cycloalkylidene group, are preferable.

(5)

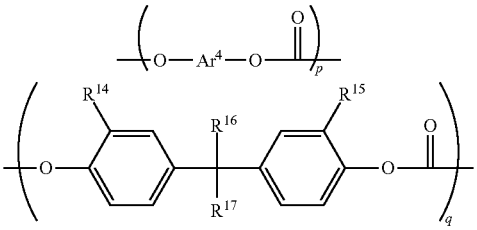

In the formula (5), p+q=1 and p is 0-0.7, and $Ar^4$ is a divalent group selected from those represented by formulas (5-1)-(5-3):

(5-1)

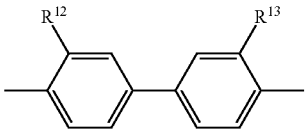

(5-2)

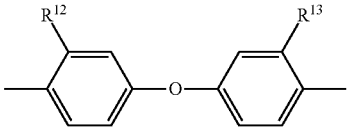

(5-3)

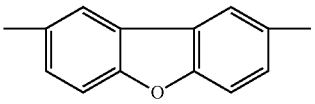

where each of $R^{12}$-$R^{17}$ is independently a hydrogen atom, an alkyl group, or an aryl group, and $R^{16}$ and $R^{17}$ are optionally bonded together to form a cycloalkylidene group.

When the substituents $R^{12}$-$R^{17}$ on the polycarbonate represented by the formula (5) is an alkyl group, the number of carbon atoms of the alkyl group is preferably at least 1 and not more than 12, more preferably at least 1 and not more than 8, and particularly preferably at least 1 and not more than 6.

When $R^{12}$-$R^{17}$ are each an alkyl group, specific examples of the alkyl group include methyl group, ethyl group, n-propyl group, iso-propyl group, n-butyl group, sec-butyl group, tert-butyl group, n-pentyl group, iso-pentyl group, tert-pentyl group, neopentyl group, n-hexyl group, iso-hexyl group, n-heptyl group, n-octyl group, 2-ethylhexyl group, tert-octyl group, n-nonyl group, n-decyl group, n-undecyl group, and dodecyl group.

In the formula (5), $R^{16}$ and $R^{17}$ are optionally bonded together to form a cycloalkylidene group. When $R^{16}$ and $R^{17}$ form a cycloalkylidene group, the ring of the cycloalkylidene group preferably contains at least 4 and not more than 8 members, more preferably 5 or 6 members, particularly preferably 6 members.

In the formula (5), when the substituents $R^{12}$-$R^{17}$ are each an aryl group, the aryl group is preferably a phenyl group, or a group which is formed by at least two and not more than six benzene rings fused by condensation or linked together by single bonds. The number of benzene rings contained in the aryl group is preferably at least 1 and not more than 6, more preferably at least 1 and not more than 3, and particularly preferably 1 or 2.

When $R^{12}$-$R^{17}$ are each an aryl group, specific examples of the aryl group include phenyl group, naphthyl group, biphenylyl group, anthryl group, phenanthryl group, and pyrenyl group.

When the polycarbonate resin represented by the formula (5) is contained in the binder resin, it is difficult for the resin and the charge transport material in the radical state to interact with each other during transportation of charge, and therefore, the movement of charge is less likely to be hindered. Therefore, electrical characteristics, such as sensitivity and electrical fatigue resistance (resistance to the reduction in surface potential due to repeated use) of the photosensitive member, can be improved.

When the binder resin contains the polycarbonate resin represented by the formula (5), the content of the polycarbonate resin represented by the formula (5) in the binder resin is preferably not more than 80% by mass, more preferably not more than 90% by mass, and particularly preferably 100% by mass.

Additives

In addition to the charge generating material, the hole transport material, the electron transport material, and the binder resin, the photosensitive layer of the photosensitive member may contain various additives as long as the electrophotographic characteristics are not adversely affected. Examples of additives which may be added to the photosensitive layer include degradation reducing agents such as antioxidants, radical scavengers, singlet quenchers, and ultraviolet absorbers, softeners, plasticizers, surface modifiers, fillers, thickeners, dispersion stabilizers, waxes, acceptors, donors, surfactants, and leveling agents.

Method of Producing Positively Charged Monolayer Electrophotographic Photosensitive Member The method of producing the positively chargeable monolayer electrophotographic photosensitive member is not particularly limited as long as it does not adversely affect the advantageous effects of the present disclosure. A suitable example method of producing the positively chargeable monolayer electrophotographic photosensitive member is as follows: an application liquid for a photosensitive layer is applied to a conductive substrate to form a photosensitive layer. Specifically, a charge generating material, a hole transport material, an electron transport material, a binder resin, and various optional additives as required may be dissolved or dispersed in a solvent to prepare an application liquid, and the application liquid may be applied to a conductive substrate, followed by drying, to produce a photosensitive layer. The application technique is not particularly limited. A specific example of the application technique may be, for example, to use a spin coater, an applicator, a spray coater, a bar coater, a dip coater, or a doctor blade. An example technique of drying the applied film formed on the conductive substrate may be hot-air drying, etc. Hot-air drying is performed, for example, under the conditions that the temperature is at least 80° C. and not more than 150° C. and the duration is at least 15 min and not more than 120 min The contents of the charge generating material, the hole transport material, the electron transport material, and the binder resin in the photosensitive member are suitably determined and are not particularly limited. Specifically, for example, the content of the charge generating material is preferably at least 0.1 and not more than 50 parts by mass per 100 parts by mass of the binder resin, more preferably at least 0.5 and not more than 30 parts by mass. The content of the electron transport material is preferably at least 5 and not more than 100 parts by mass per 100 parts by mass of the binder resin, more preferably at least 10 and not more than 80 parts by mass. The content of the hole transport material is preferably at least 5 and not more than 500 parts by mass per 100 parts by mass of the binder resin, more preferably at least 25 and not more than 200 parts by mass. The sum amount of the hole transport material and the electron transport material, i.e., the content of the charge transport material, is preferably at least 20 and not more than 500 parts by mass per 100 parts by mass of the binder resin, more preferably at least 30 and not more than 200 parts by mass.

The thickness of the photosensitive layer of the photosensitive member is not particularly limited as long as the thickness allows the photosensitive layer to function satisfactorily. Specifically, for example, the thickness is preferably at least 5 μm and not more than 100 μm, more preferably at least 10 μm and not more than 50 μm.

The solvent contained in the application liquid for the photosensitive layer is not particularly limited as long as the solvent allows the components of the photosensitive layer to be dissolved or dispersed therein. Specifically, examples of the solvent include: alcohols such as methanol, ethanol, isopropanol, and butanol; aliphatic hydrocarbons such as n-hexane, octane, and cyclohexane; aromatic hydrocarbons such as benzene, toluene, and xylene; halogenated hydrocarbons such as dichloromethane, dichloroethane, carbon tetrachloride, and chlorobenzene; ethers such as dimethyl ether, diethyl ether, tetrahydrofuran, ethylene glycol dimethyl ether, and diethylene glycol dimethyl ether; ketones such as acetone, methyl ethyl ketone, methyl isobutyl ketone, and cyclohexane; esters such as ethyl acetate and methyl acetate; and aprotic polar organic solvents such as dimethyl formaldehyde, dimethyl formamide, and dimethyl sulfoxide. These solvents may be used alone or in combination.

The above-described positively chargeable monolayer electrophotographic photosensitive member of the first embodiment can reduce or prevent transfer memory to reduce or prevent the occurrence of a defect in an image. Therefore, the positively chargeable monolayer electrophotographic photosensitive member of the first embodiment is suitably used as an image bearing member in a variety of image forming apparatuses.

Second Embodiment

A second embodiment is directed to an image forming apparatus including an image bearing member, a charger for charging a surface of the image bearing member, an exposure unit for exposing the charged surface of the image bearing member to light to form an electrostatic latent image on the surface of the image bearing member, a development unit for developing the electrostatic latent image to a toner image, and a transfer unit for transferring the toner image from the image bearing member to a transfer member. The image forming apparatus employs the positively chargeable monolayer electrophotographic photosensitive member of the first embodiment as the image bearing member.

The image forming apparatus of the present disclosure may be preferably a monochromatic image forming apparatus, or a tandem color image forming apparatus employing a plurality of toners of different colors described below. More specifically, for example, the image forming apparatus of the present disclosure may be the tandem color image forming apparatus employing a plurality of toners of different colors described below. The tandem color image forming apparatus will now be described.

Note that the tandem color image forming apparatus of this embodiment including the positively chargeable monolayer electrophotographic photosensitive member includes a plurality of image bearing members and a plurality of development units. The image bearing members are arranged side by side in a predetermined direction so that toner images are formed of the toners of different colors on the surfaces of the image bearing members. The development units each include a development roller opposed to the corresponding image bearing member. The development roller bears toner on a surface thereof for conveyance. The development roller supplies the conveyed toner to the surface of the corresponding image bearing member. As the image bearing member, the positively chargeable monolayer electrophotographic photosensitive member of the first embodiment is employed.

Figure 2:
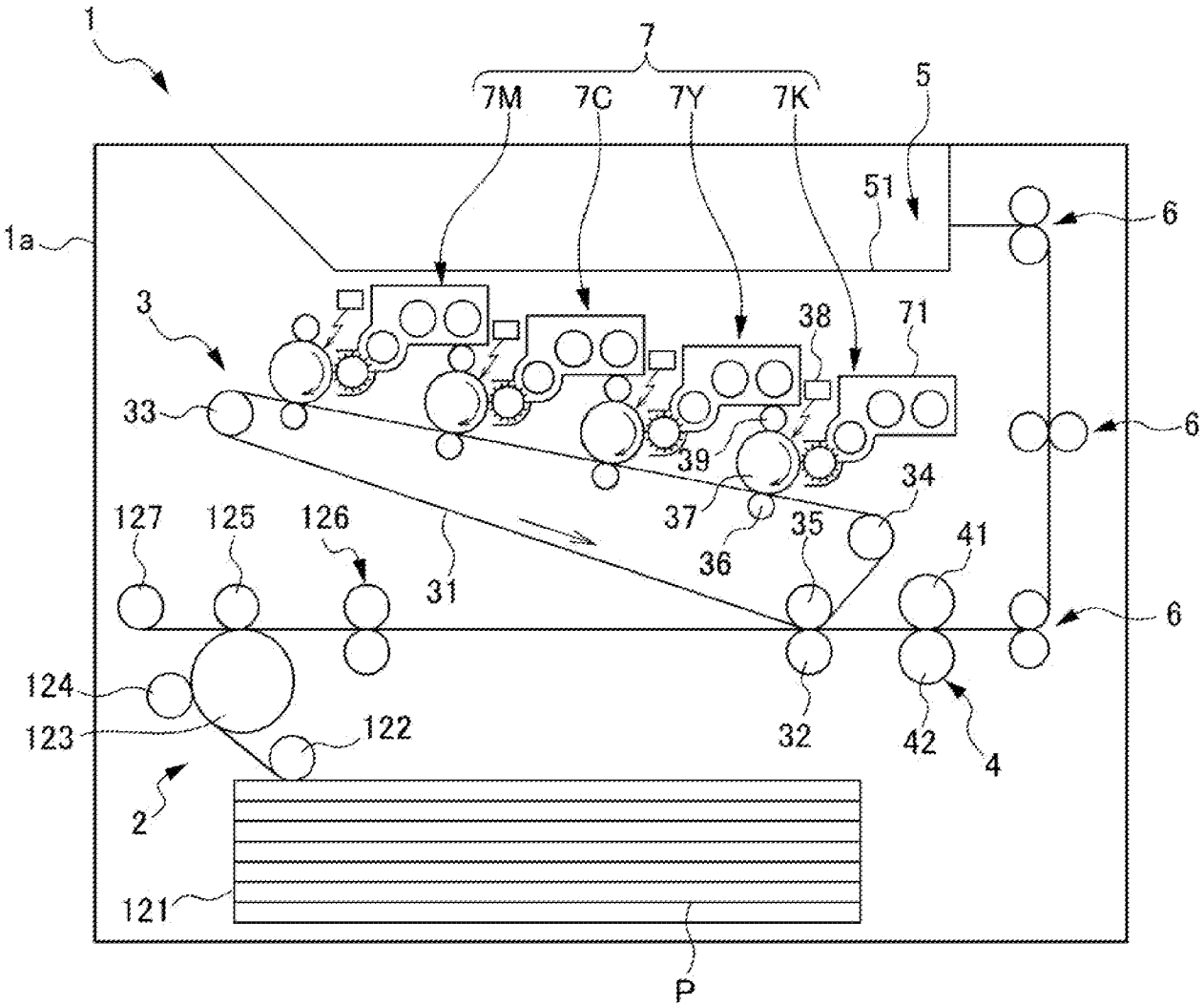
FIG. 2 is a diagram schematically showing a configuration of an image forming apparatus according to an example of the present disclosure.

FIG. 2 is a diagram schematically showing a configuration of the image forming apparatus including the positively chargeable monolayer electrophotographic photosensitive member of the embodiment of the present disclosure. A color printer 1 will now be described as an example of the image forming apparatus.

As shown in FIG. 2, the color printer 1 has a box-shaped apparatus body 1*a*. In the apparatus body 1*a*, a paper feeder 2, an image forming unit 3, and a fixing unit 4 are provided. The paper feeder 2 feeds a sheet P. The image forming unit 3 transfers to the sheet P a toner image based image data etc. while transporting the sheet P fed from the paper feeder 2. The fixing unit 4 performs a fixing process of fixing, to the sheet P, the unfixed toner image which has been transferred to the sheet P by the image forming unit 3. A paper output unit 5 is also provided at an upper surface of the apparatus body 1*a*. The paper output unit 5 collects the sheet P which has been subjected to the fixing process by the fixing unit 4.

The paper feeder 2 includes a paper feed cassette 121, a pickup roller 122, feed rollers 123, 124, and 125, and a registration roller 126. The paper feed cassette 121, which is removably inserted into the apparatus body 1*a*, stores sheets P having a predetermined size. The pickup roller 122, which is provided at an upper left position (FIG. 2) of the paper feed cassette 121, picks up the sheets P stored in the paper feed cassette 121, one sheet at a time. The feed rollers 123, 124, and 125 feed, to a paper transport path, the sheet P picked up by the pickup roller 122. The registration roller 126 temporarily stops the sheet P which has been fed to the paper transport path by the feed rollers 123, 124, and 125, and thereafter, supplies the sheet P to the image forming unit 3 with predetermined timing.

The paper feeder 2 also includes a bypass tray (not shown) which is attached to a left side surface (FIG. 2) of the apparatus body 1*a*, and a pickup roller 127. The pickup roller 127 picks up a sheet P placed on the bypass tray. The sheet P picked up by the pickup roller 127 is fed to the paper transport path by the feed rollers 123 and 125, and is then supplied by the registration roller 126 to the image forming unit 3 with predetermined timing.

The image forming unit 3 includes an image forming unit 7, an intermediate transfer belt 31, and a second-order transfer roller 32. A toner image which is formed by the image forming unit 7 based on image data transmitted from a computer etc. is transferred (first-order transfer) to a surface (contact surface) of the intermediate transfer belt 31. The second-order transfer roller 32 transfers (second-order transfer) the toner image on the intermediate transfer belt 31 to the sheet P fed from the paper feed cassette 121.

The image forming unit 7 includes a black unit 7K, a yellow unit 7Y, a cyan unit 7C, and a magenta unit 7M which are sequentially arranged from upstream (right in FIG. 2) to downstream. A positively chargeable monolayer electrophotographic photosensitive member 37 (hereinafter referred to as a photosensitive member 37) serving as an image bearing member is provided at a middle position of each of the units 7K, 7Y, 7C, and 7M, and is allowed to rotate in a direction (clockwise) indicated by an arrow. A charger 39, an exposure unit 38, a development unit 71, a cleaner (not shown), and an optional charge neutralizing unit (not shown) as required are provided around each photosensitive member 37 sequentially from upstream to downstream in the rotational direction. Note that, as the photosensitive member 37, the positively chargeable monolayer electrophotographic photosensitive member of the first embodiment is employed.

The charger 39 uniformly charges a circumferential surface of the photosensitive member 37 rotating in the direction indicated by the arrow. The charger 39 is not particularly limited as long as the charger can uniformly charge the circumferential surface of the photosensitive member 37, and may be either a non-contact charger or a contact charger. Specific examples of the charger 39 include a corona charging device, a charging roller, and a charging brush. Of these chargers, the charger 39 is more preferably a contact charger, such as a charging roller or a charging brush, particularly preferably a charging roller. Employment of a contact charger as the charger 39 may reduce or prevent the emission of active gas, such as ozone or nitrogen oxide, which is generated from the charger 39. This can reduce or prevent the degradation of the photosensitive layer of the photosensitive member due to the active gas, and a design contributing to a better office environment etc. can be provided.

When the charger 39 includes a contact charging roller, the charging roller charges the circumferential surface of the photosensitive member 37 while being in contact with the photosensitive member 37. An example of such a charging roller is a roller which is rotated followed by rotation of the photosensitive member 37 while being in contact with the photosensitive member 37. Another example of the charging roller is a roller at least a surface portion of which is formed of a resin. More specifically, for example, such a roller includes a cored bar rotatably supported, a resin layer formed on the cored bar, and a voltage applying portion for applying a voltage to the cored bar. A charger including such a charging roller can charge the surface of the photosensitive member 37 which is in contact with the charging roller with the resin layer being interposed therebetween, by applying a voltage to the cored bar at the voltage applying portion.

The voltage applied to the charging roller at the voltage applying portion is not particularly limited. Compared to an alternative-current voltage or a voltage which is obtained by superimposing an alternating-current voltage on a direct-current voltage, it is preferable to apply only a direct-current voltage to the charging roller. When only a direct-current voltage is applied to the charging roller, the amount of wear of the photosensitive layer tends to be smaller, leading to formation of a suitable image. The direct-current voltage applied to the photosensitive member is preferably at least 1000 and not more than 2000 V, more preferably at least 1200 and not more than 1800 V, and particularly preferably at least 1400 and not more than 1600 V.

The resin contained in the resin layer of the charging roller is not particularly limited as long as the resin allows the circumferential surface of the photosensitive member 37 to be satisfactorily charged. Specific examples of the resin contained in the resin layer include silicone resins, urethane resins, and silicone-modified resins. The resin layer may also contain an inorganic filler.

The exposure unit 38 is a so-called laser scanning unit. The exposure unit 38 irradiates the circumferential surface of the photosensitive member 37 which has been uniformly charged by the charger 39, with laser light based on image data input from a personal computer (PC) which is a higher-level apparatus, to form on the photosensitive member 37 an electrostatic latent image based on the image data. The development unit 71 supplies toner to the circumferential surface of the photosensitive member 37 on which the electrostatic latent image has been formed, to form a toner image based on the image data. Thereafter, the toner image is transferred (first-order transfer) to the intermediate transfer belt 31. The cleaner removes residual toner from the circumferential surface of the photosensitive member 37 after the first-order transfer of the toner image to the intermediate transfer belt 31. The charge neutralizing unit neutralizes charge on the circumferential surface of the photosensitive member 37 after the first-order transfer. The circumferential surface of the photosensitive member 37 which has been subjected to the cleaning process by the cleaner and the charge neutralizing unit, is moved to the charger 39 for a new charging process, which is then performed. Note that the cleaner and the charge neutralizing unit are not shown.

The intermediate transfer belt 31 is an endless belt loop which can rotate. The intermediate transfer belt 31 are supported by a plurality of rollers (a drive roller 33, an idler roller 34, a backup roller 35, and first-order transfer rollers 36), spanning the spaces between each roller. A surface (contact surface) of the intermediate transfer belt 31 is in contact with the circumferential surface of each photosensitive member 37. The intermediate transfer belt 31 is configured to be rotated about the rollers while being pressed against the photosensitive members 37 by the first-order transfer rollers 36 opposed to the photosensitive members 37. The drive roller 33 is driven by a drive source which is, for example, a stepping motor, whereby the intermediate transfer belt 31 rotates about the rollers. The idler roller 34, the backup roller 35, and the first-order transfer roller 36, which are rotatably provided, are rotated followed by rotation of the intermediate transfer belt 31 by the drive roller 33. The rollers 34, 35, and 36 are rotated by friction drive which is caused by main rotational drive of the drive roller 33 via the intermediate transfer belt 31, and support the intermediate transfer belt 31.

The intermediate transfer belt 31 is driven by the drive roller 33 to circulate and pass between the photosensitive members 37 and the first-order transfer rollers 36 in a direction indicated by an arrow (counterclockwise). The first-order transfer rollers 36 apply a first-order transfer bias (with a polarity opposite to the polarity of charge on the toner) to the intermediate transfer belt 31. As a result, the toner images on the photosensitive members 37 are sequentially transferred (first-order transfer) to the intermediate transfer belt 31 so that the toner images are superimposed together. Thereafter, when desired, charge is neutralized on the surfaces of the photosensitive members 37 by the charge neutralizing unit (not shown) using light. Thereafter, the photosensitive members 37 are further rotated and transitioned to the next process.

The second-order transfer roller 32 applies to the sheet P a second-order transfer bias having a polarity opposite to that of the toner image. As a result, the toner image transferred (first-order transfer) to the intermediate transfer belt 31 is transferred to the sheet P between the second-order transfer roller 32 and the backup roller 35. Thus, a color toner image is transferred to the sheet P.

Note that, in the second embodiment, the intermediate-transfer-type image forming apparatus including the intermediate transfer belt 31 has been described. Alternatively, the positively chargeable monolayer electrophotographic photosensitive member of the first embodiment may be suitably used in a direct-transfer-type image forming apparatus. In the direct-transfer-type image forming apparatus, a toner image developed on the surface of the photosensitive member 37 is directly transferred to a sheet P transported by a transfer belt (not shown). In the direct-transfer-type image forming apparatus, charge is likely to be reduced due to influence of sheet-P-borne matter adhering to the surface of the photosensitive member 37. The influence of the charge reduction causes the influence of transfer memory to be significant in the direct-transfer-type image forming apparatus. However, if a direct-transfer-type image forming apparatus includes the positively chargeable monolayer electrophotographic photosensitive member of the first embodiment, the influence of transfer memory can be reduced.

The fixing unit 4 performs a fixing process on the transferred image which has been transferred to the sheet P by the image forming unit 3. The fixing unit 4 includes a hot roller 41 which is heated by an electrical heating element, and a pressure roller 42 which is opposed to the hot roller 41 and whose circumferential surface is in contact with and pressed against the circumferential surface of the hot roller 41.

Thereafter, the transferred image which has been transferred to the sheet P by the second-order transfer roller 32 in the image forming unit 3, is fixed to the sheet P by heating in the fixing process when the sheet P is passed between the hot roller 41 and the pressure roller 42. The sheet P which has been subjected to the fixing process is discharged to the paper output unit 5. In the color printer 1 of this embodiment, transport rollers 6 are provided at appropriate positions between the fixing unit 4 and the paper output unit 5.

The paper output unit 5 is a top hollow portion of the apparatus body 1*a* of the color printer 1. A paper output tray 51 which collects the discharged sheet P is arranged at a bottom of the hollow portion.

The color printer 1 forms an image on the sheet P by the above-described image forming operation. The above-described tandem color image forming apparatus includes the positively chargeable monolayer electrophotographic photosensitive member of the first embodiment as an image bearing member. Therefore, transfer memory is reduced or prevented, whereby a suitable image can be formed.

EXAMPLES

The present disclosure will now be described in greater detail by way of example. Note that the present disclosure is not intended to be limited to examples described below.

In examples and comparative examples described below, the following hole transport materials HTM-1-HTM-11 and electron transport materials ETM-1-ETM-6 were used:

Hole Transport Materials:

HTM-1

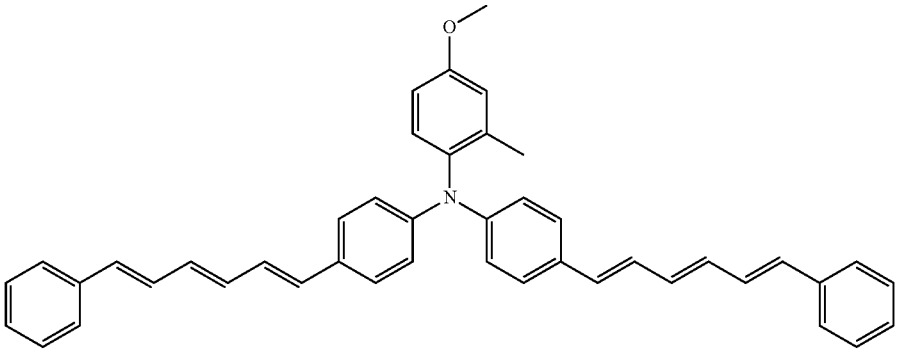

HTM-2

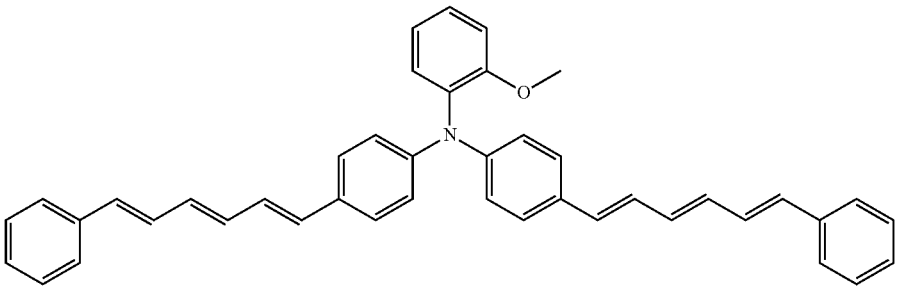

-continued
HTM-3
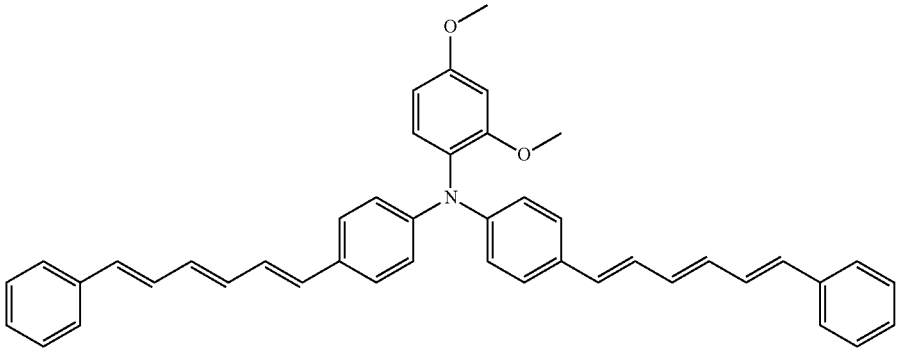
HTM-4
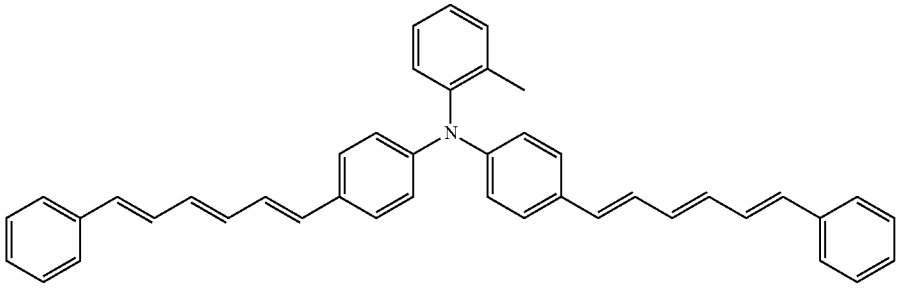
HTM-5
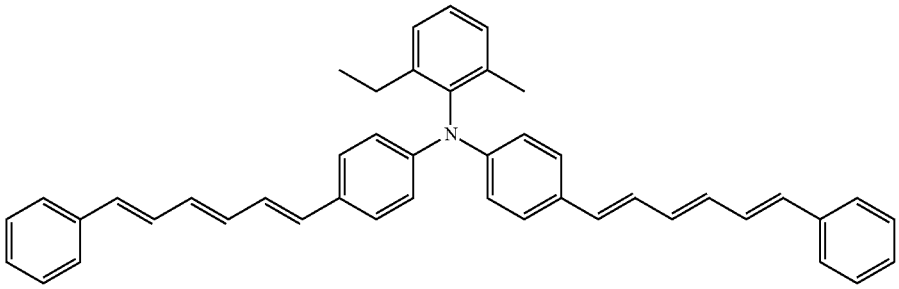
HTM-6
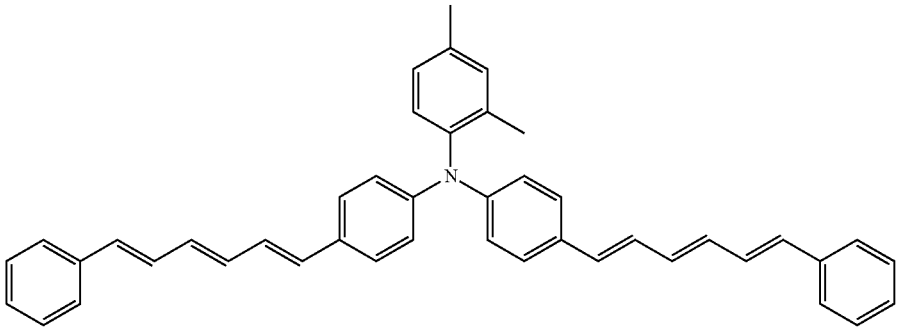
HTM-7
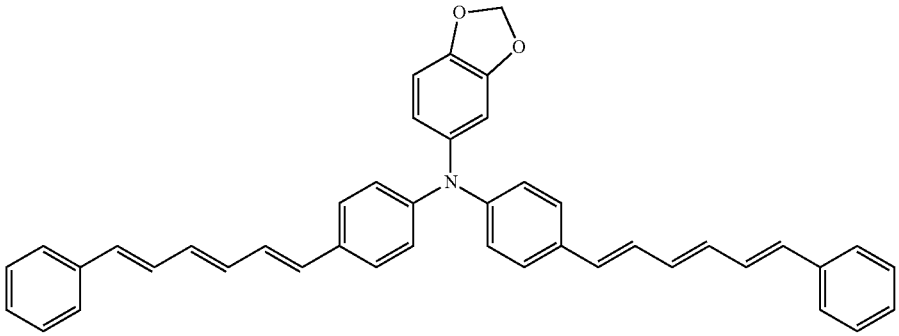

-continued
HTM-8
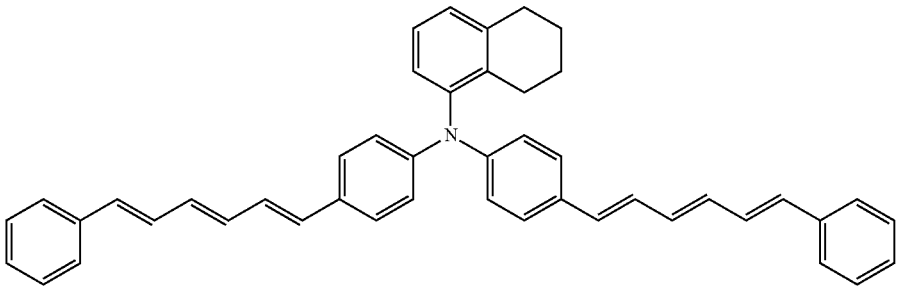
HTM-9
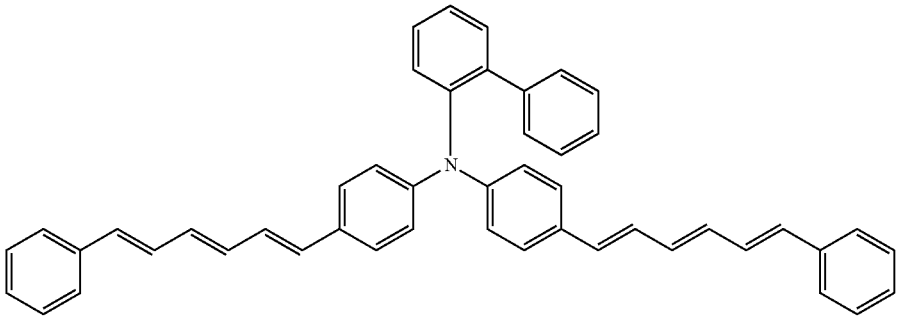
HTM-10
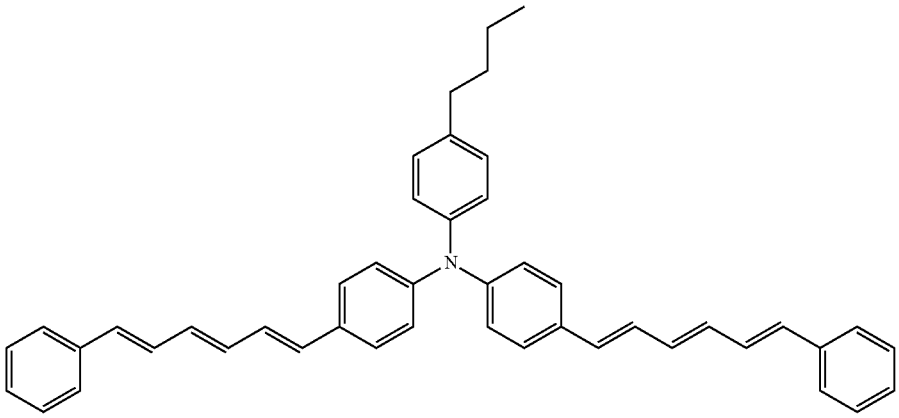
HTM-11
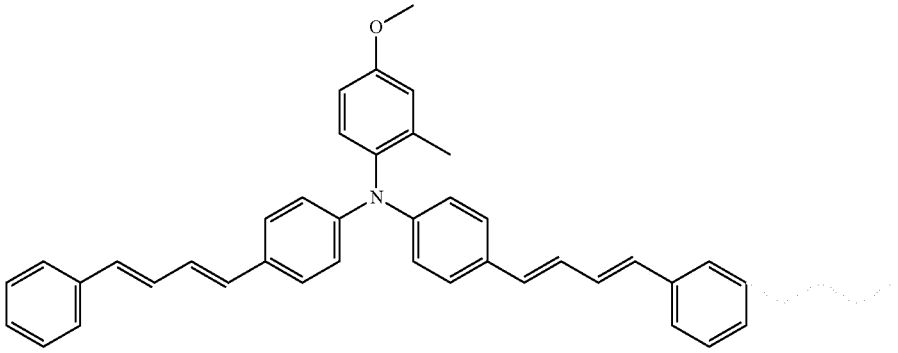

Electron Transport Materials:

ETM-1

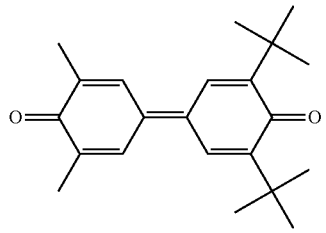

ETM-2

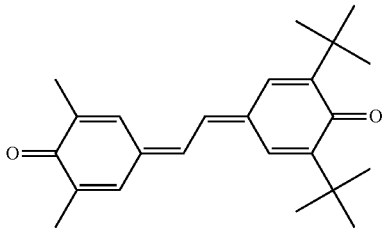

ETM-3

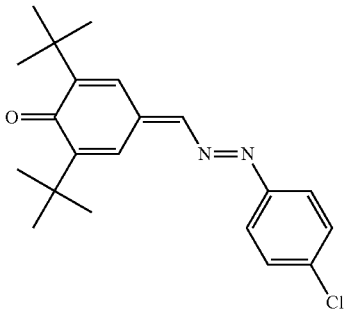

ETM-4

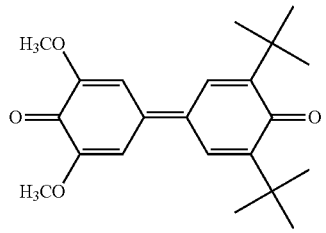

ETM-5

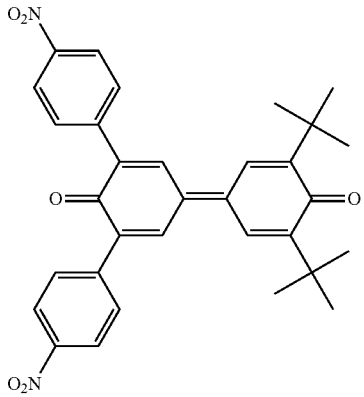

-continued

ETM-6

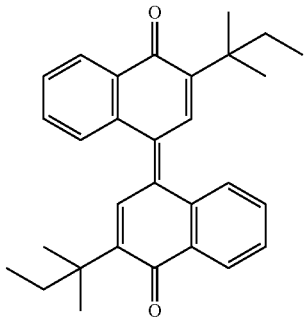

ETM-7

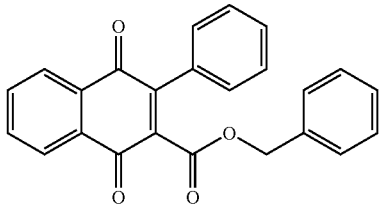

ETM-8

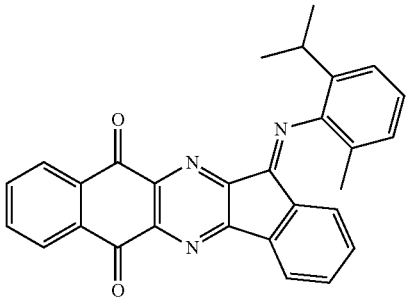

The reduction potentials and drift mobilities of ETM-1-ETM-8 were measured using methods described below. The drift mobilities and reduction potentials of ETM-1-ETM-8 are shown in Table 1.

Method of Measuring Drift Mobility

A bisphenol Z polycarbonate resin having a viscosity average molecular weight of 50,000 and an electron transport material which is 30% by mass of the total mass of the sample were added to an organic solvent. Thereafter, the polycarbonate resin and the electron transport material were dissolved in the organic solvent to prepare an application liquid. The application liquid thus prepared was applied to a substrate made of aluminum, followed by a thermal treatment at 80° C. for 30 min Thereafter, the solvent was removed to form an applied film having a thickness of 5 μm. Next, a translucent gold electrode was formed on the applied film by a vacuum vapor deposition technique to prepare a measurement sample. The sample thus prepared was used to measure the drift mobility using a time-of-flight (TOF) technique under the conditions that the temperature is 23° C. and the field intensity is $3.0\times10^5$ V/cm.

Method of Measuring Reduction Potential

The reduction potential was determined by cyclic voltammetry under the following measurement conditions.

Working electrode: glassy carbon

Counter electrode: platinum

Reference electrode: silver/silver nitrate (0.1 mol/L, $AgNO_3$-acetonitrile solution)

Sample solution electrolyte: tetra-n-butylammonium perchlorate (0.1 mol)

Substance to be measured: electron transport material (0.001 mol)

Solvent: dichloromethane (1 L)

TABLE 1

| | Drift Mobility ($cm^2/V \cdot sec$) | Reduction Potential (V) |
|---|---|---|
| ETM-1 | $5.0 \times 10^{-7}$ | −0.93 |
| ETM-2 | $6.4 \times 10^{-7}$ | −0.96 |
| ETM-3 | $6.5 \times 10^{-7}$ | −0.92 |
| ETM-4 | $1.1 \times 10^{-8}$ | −1.1 |
| ETM-5 | $1.6 \times 10^{-8}$ | −0.77 |
| ETM-6 | $4.7 \times 10^{-7}$ | −0.88 |
| ETM-7 | $1.9 \times 10^{-7}$ | −0.96 |
| ETM-8 | $1.9 \times 10^{-7}$ | −0.96 |

In the examples and the comparative examples, X-form metal-free phthalocyanine (X—$H_2$Pc) and oxotitanyl phthalocyanine (TiOPc) were used as the charge generating material.

In the examples and the comparative examples, the following Resin-1-Resin-6 were used as the binder resin.

Resin-1

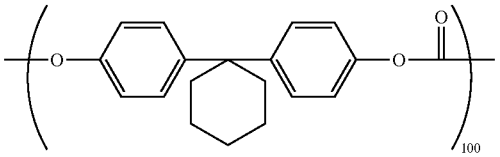

Resin-2

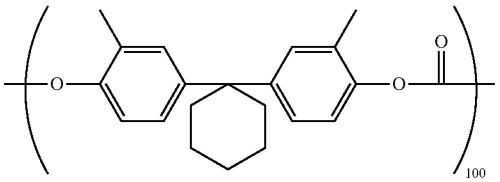

Resin-3

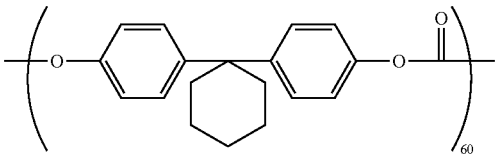

Resin-4

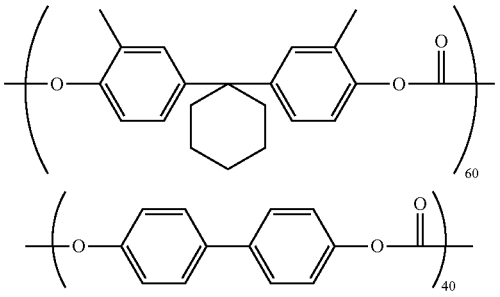

-continued

Resin-5

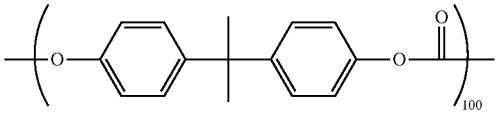

Resin-6

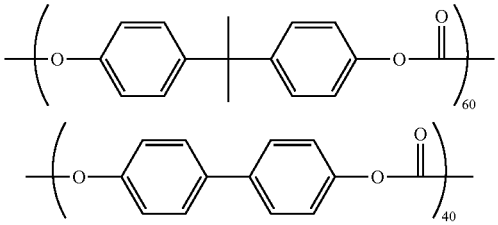

A method for synthesizing THM-1-THM-10 will now be described as Synthesis Examples 1-10.

Synthesis Example 1

Production of HTM-1

Step A

In a 200-ml pear-shaped flask, 20.0 g (0.13 mol) of a compound (1-a) and 25.0 g (0.15 mol) of triethyl phosphite were placed, and then allowed to react at 180° C. for 5 h. After cooling, excess triethyl phosphite was removed by heating under reduced pressure to obtain 29.8 g of a compound (1-b) as white liquid. The yield was 90%.

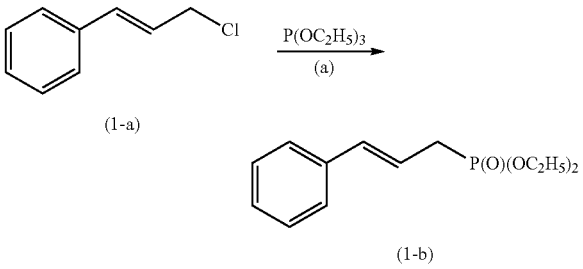

Step B

A 500-ml flask with two necks, purged with argon gas, was cooled to 0° C. Thereafter, while the temperature was kept at 0° C., 20.0 g (0.08 mol) of the compound (1-b), 100 ml of dried tetrahydrofuran, and 16.7 g (0.09 mol) of methanol solution containing sodium methoxide having a concentration of 28% by mass were placed in the flask with two necks. The solution was stirred in the flask at 0° C. for 30 min Thereafter, 13.1 g (0.08 mol) of a compound (1-c) and 100 ml of dried tetrahydrofuran were added. The mixture was allowed to react at room temperature for 12 h while being stirred. After the end of the reaction, the reaction solution was poured into 300 ml of ion exchanged water. A compound (1-d) was extracted using 100 ml of toluene at room temperature. After the extraction, the organic phase (toluene phase) was washed with 100 ml of ion exchanged water five times, and then dried on anhydrous sodium sulfate. After the sodium sulfate was filtered, the organic phase was dried. The residue was recrystallized using a mixture solvent of 20 ml of toluene and 100 ml of methanol to obtain 16.8 g of a white crystal of the compound (1-d). The yield was 80%.

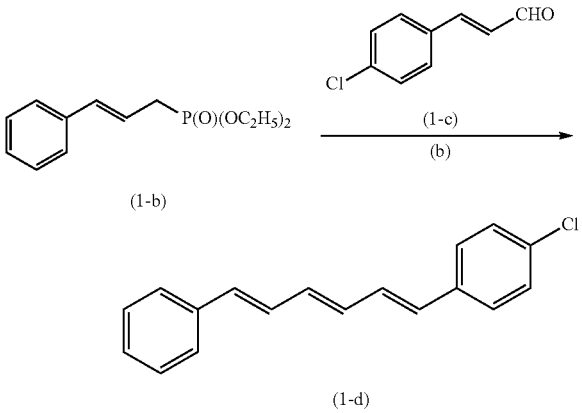

Step C

Figure 3:
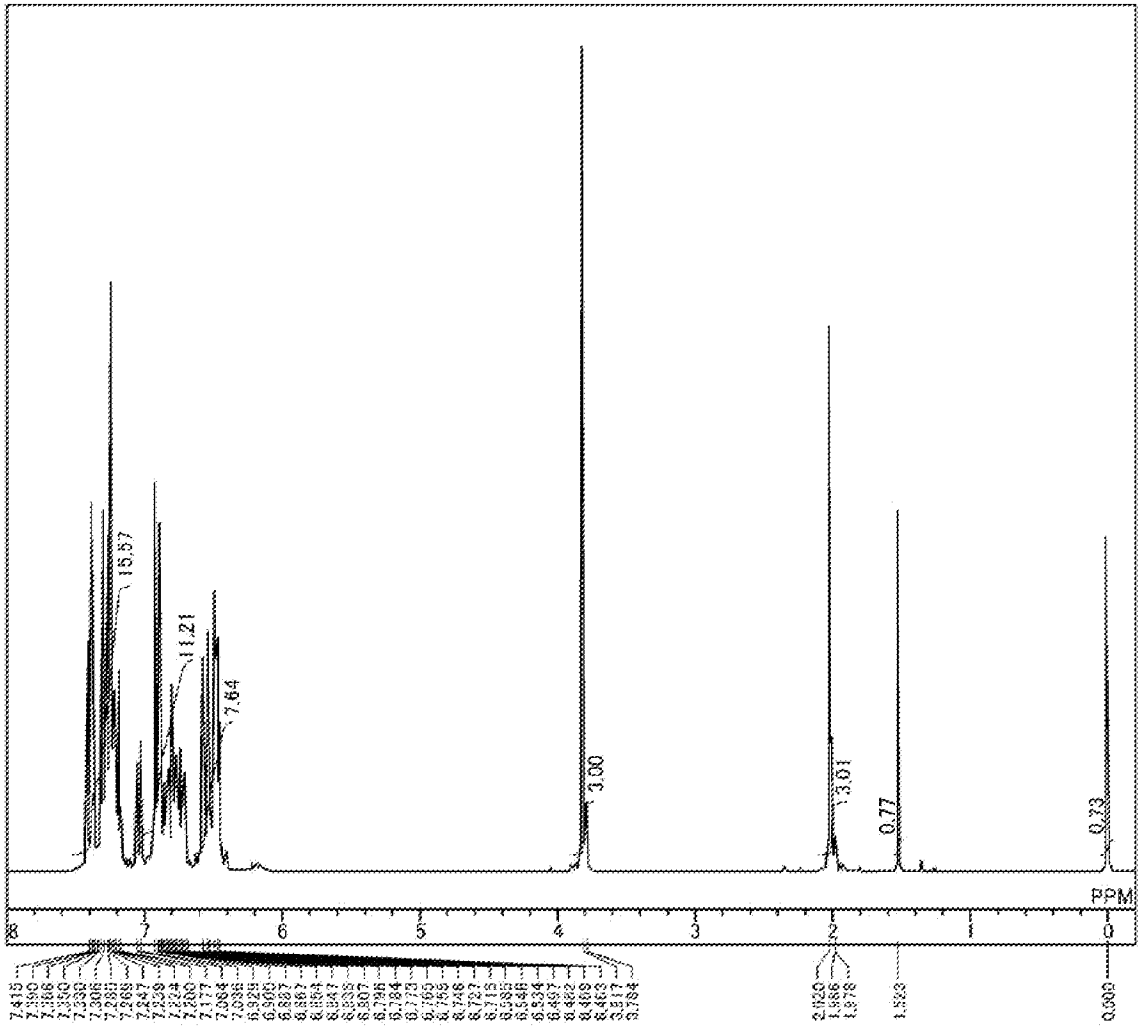
FIG. 3 is a diagram showing a $^1$H-NMR spectrum (300 MHz) of a triarylamine derivative (HTM-1).

To a 300-ml flask with two necks, purged with argon gas, 12.5 g (0.0469 mol) of the compound (1-d), 0.082 g (0.002 mol) of 2-(dicyclohexylphosphino)biphenyl, 0.108 g (0.0001 mol) of tris(dibenzylideneacetone)dipalladium (0), 4.87 g (0.0507 mol) of sodium tert-butoxide, 3.20 g (0.0234 mol) of a compound (1-e), and 100 ml of distilled o-xylene were added, and then allowed to react at 120° C. for 5 h while being stirred. The resultant reaction liquid was cooled to room temperature, followed by treatment with activated clay. The solvent was removed by evaporation from the treated reaction liquid. The residue was purified by column chromatography (developing solvent: chloroform/hexane) to obtain 12.0 g of a yellow-orange crystal of HTM-1. The yield was 86%. FIG. 3 shows a $^1$H-NMR spectrum (300 MHz) of the obtained triarylamine derivative (solvent: $CDCl_3$, reference substance: TMS).

Synthesis Example 2

Production of HTM-2

HTM-2 was obtained in an amount of 11.1 g as in Synthesis Example 1, except that the compound (1-e) was replaced with 2-methoxyaniline. In step C, the yield was 80%.

Synthesis Example 3

Production of HTM-3

HTM-3 was obtained in an amount of 11.5 g as in Synthesis Example 1, except that the compound (1-e) was replaced with 2,4-dimethoxyaniline. In step C, the yield was 83%.

Synthesis Example 4

Production of HTM-4

Figure 4:
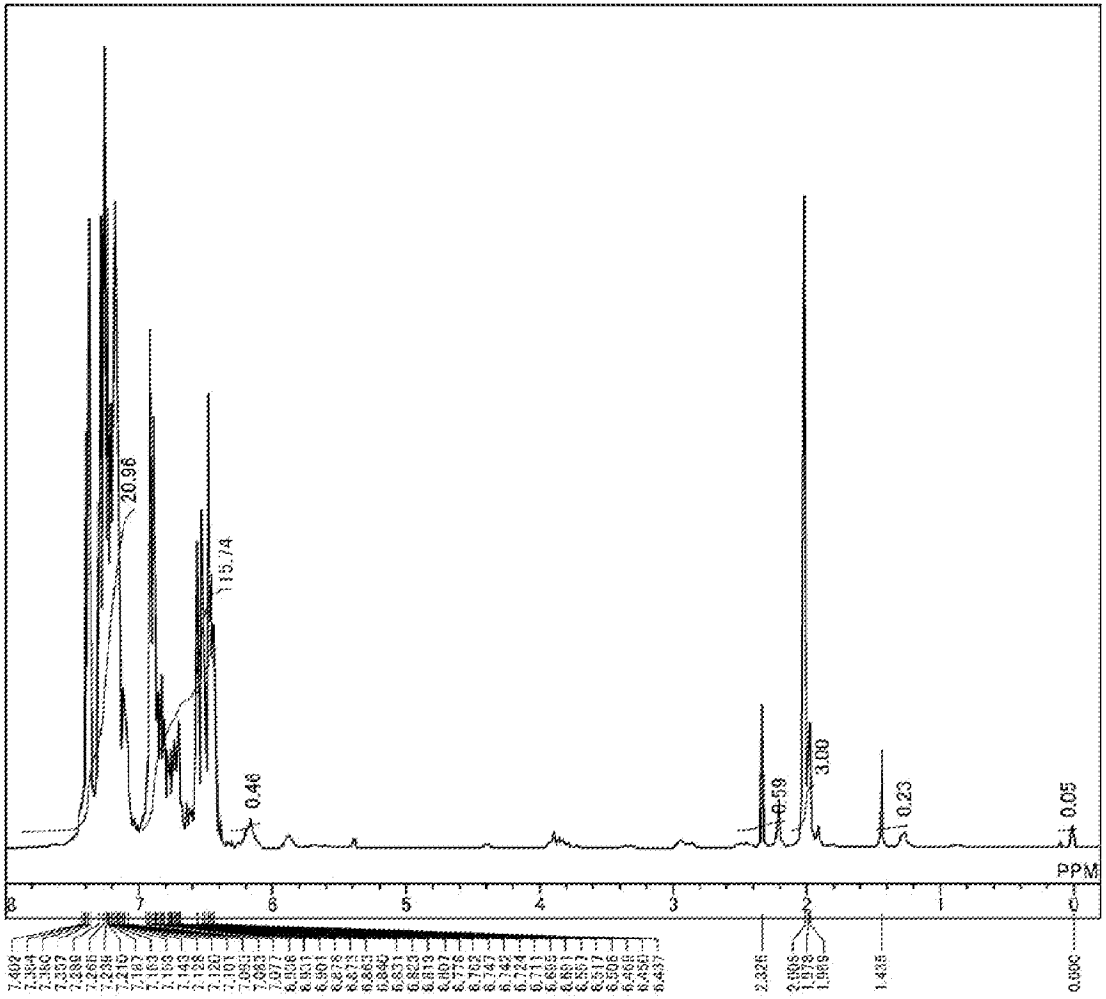
FIG. 4 is a diagram showing a $^1$H-NMR spectrum (300 MHz) of a triarylamine derivative (HTM-4).

HTM-4 was obtained in an amount of 11.7 g as in Synthesis Example 1, except that the compound (1-e) was replaced with o-toluidine. In step C, the yield was 88%. FIG. 4 shows a $^1$H-NMR spectrum (300 MHz) of the obtained triarylamine derivative (solvent: $CDCl_3$, reference substance: TMS).

Synthesis Example 5

Production of HTM-5

Figure 5:
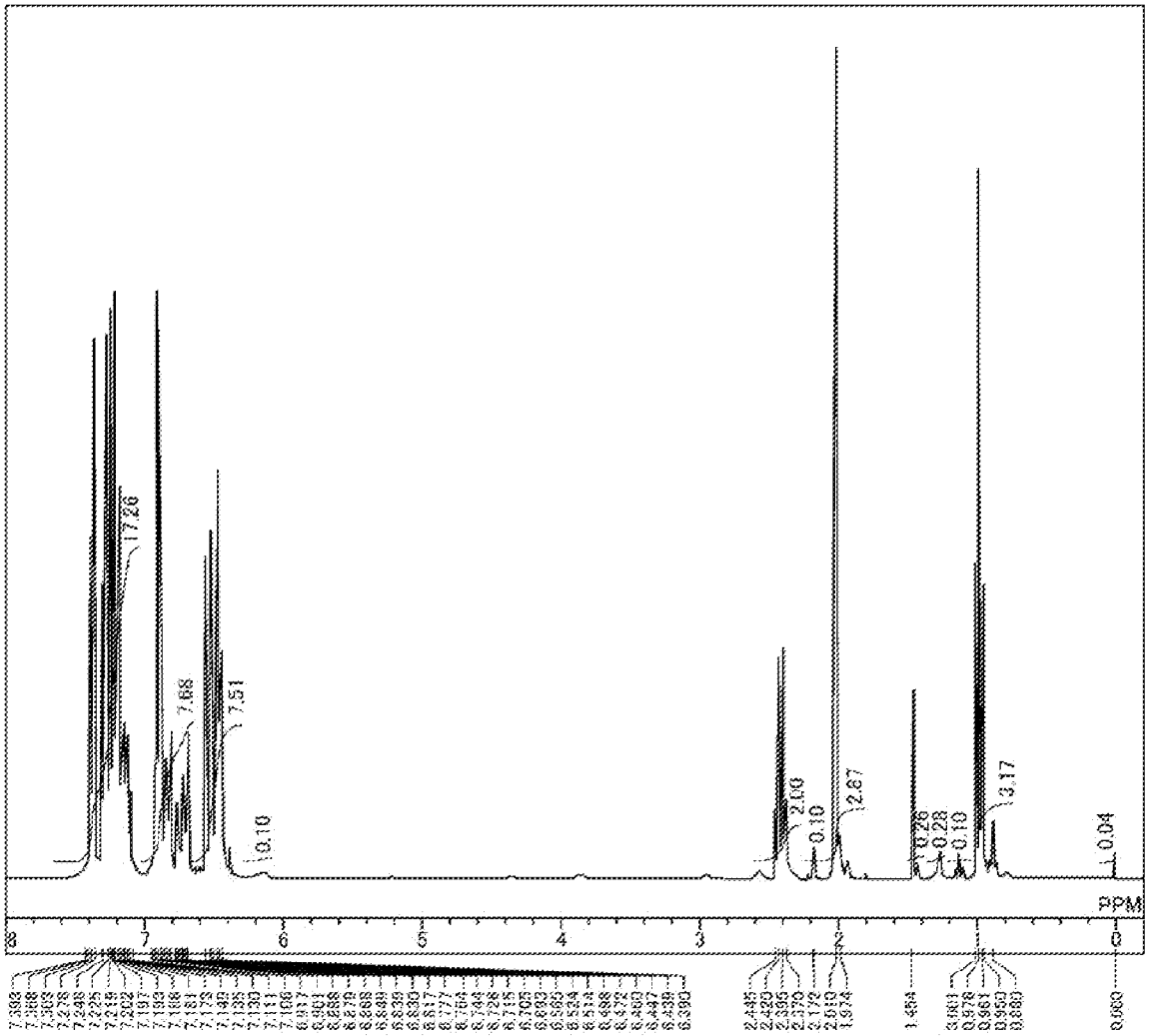
FIG. 5 is a diagram showing a $^1$H-NMR spectrum (300 MHz) of a triarylamine derivative (HTM-5).

HTM-5 was obtained in an amount of 11.5 g as in Synthesis Example 1, except that the compound (1-e) was replaced with 2-ethyl-6-methylaniline. In step C, the yield was 83%. FIG. 5

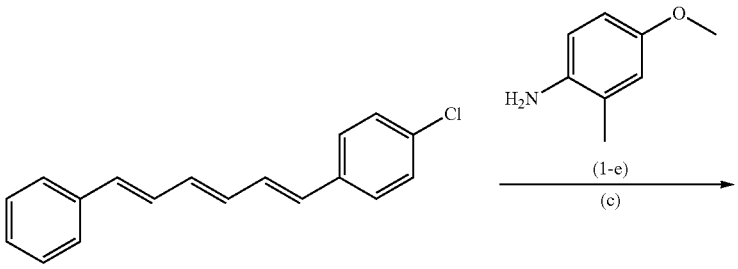

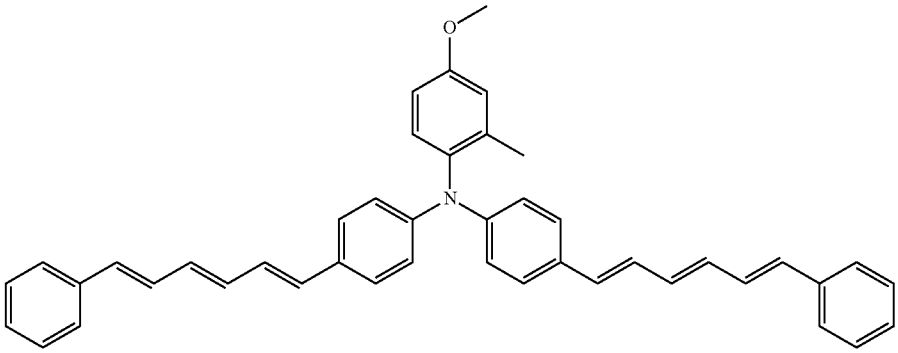

HTM-1 shows a $^1$H-NMR spectrum (300 MHz) of the obtained triarylamine derivative (solvent: $CDCl_3$, reference substance: TMS).

Synthesis Example 6

Production of HTM-6

HTM-6 was obtained in an amount of 12.2 g as in Synthesis Example 1, except that the compound (1-e) was replaced with 2,4-dimethoxyaniline. In step C, the yield was 86%.

Synthesis Example 7

Production of HTM-7

HTM-7 was obtained in an amount of 11.1 g as in Synthesis Example 1, except that the compound (1-e) was replaced with 3,4-methylenedioxyaniline. In step C, the yield was 80%.

Synthesis Example 8

Production of HTM-8

Figure 6:
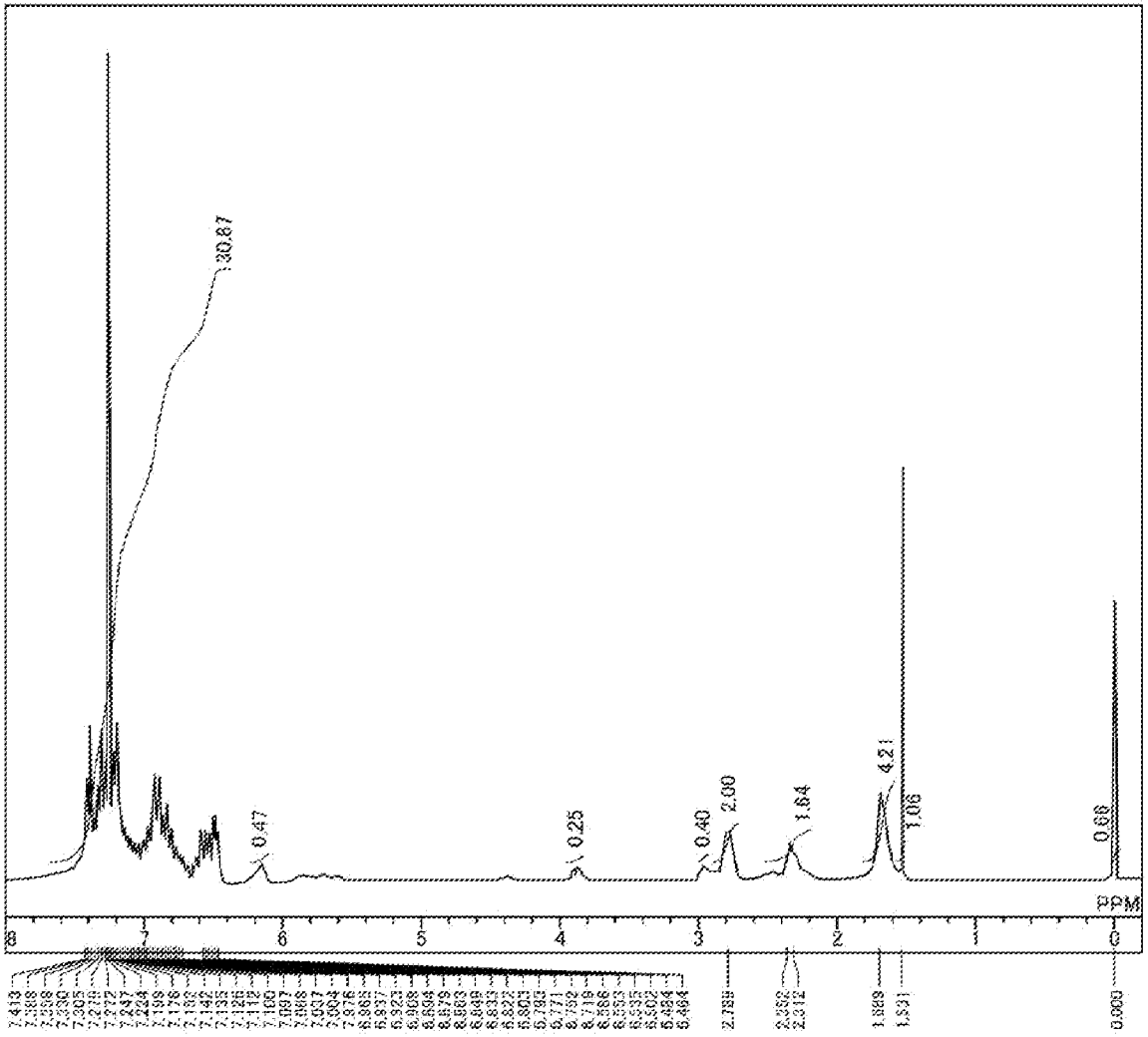
FIG. 6 is a diagram showing a $^1$H-NMR spectrum (300 MHz) of a triarylamine derivative (HTM-8).

HTM-8 was obtained in an amount of 11.8 g as in Synthesis Example 1, except that the compound (1-e) was replaced with 5-aminotetralin. In step C, the yield was 83%. FIG. 6 shows a $^1$H-NMR spectrum (300 MHz) of the obtained triarylamine derivative (solvent: $CDCl_3$, reference substance: TMS).

Synthesis Example 9

Production of HTM-9

HTM-9 was obtained in an amount of 12.1 g as in Synthesis Example 1, except that the compound (1-e) was replaced with 2-aminobiphenyl. In step C, the yield was 82%.

Synthesis Example 10

Production of HTM-10

Figure 7:
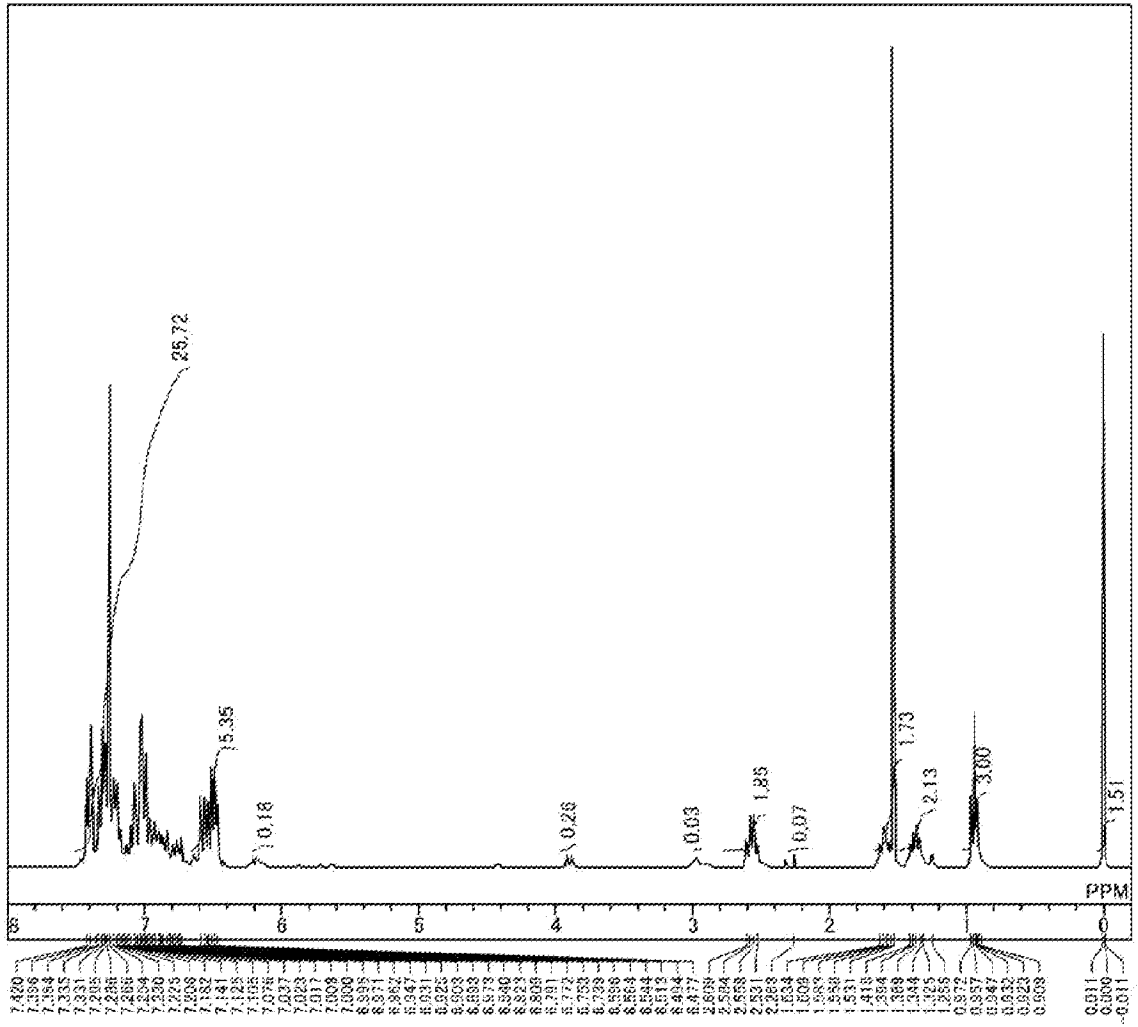
FIG. 7 is a diagram showing a $^1$H-NMR spectrum (300 MHz) of a triarylamine derivative (HTM-10).

HTM-10 was obtained in an amount of 12.2 g as in Synthesis Example 1, except that the compound (1-e) was replaced with p-n-butylaniline. In step C, the yield was 86%. FIG. 7 shows a $^1$H-NMR spectrum (300 MHz) of the obtained triarylamine derivative (solvent: $CDCl_3$, reference substance: TMS).

Examples 1-38 and Comparative Examples 1-9

In the examples and the comparative examples, charge generating materials, hole transport materials, electron transport materials, and binder resins described in Table 2 were used. Five parts by mass of a charge generating material, 50 parts by mass of a hole transport material, 35 parts by mass of an electron transport material, 100 parts by mass of a binder resin, and 800 parts by mass of tetrahydrofuran were added to a ball mill, followed by mixing and dispersion for 50 h, to prepare an application liquid for a photosensitive layer. The application liquid thus prepared was applied to a conductive substrate by a dip coating technique, followed by removal of tetrahydrofuran by a treatment at 100° C. for 40 min, to obtain a positively chargeable monolayer electrophotographic photosensitive member including a photosensitive layer having a thickness of 30 μm.

Evaluation of Image

The positively chargeable monolayer electrophotographic photosensitive members obtained in the above examples and comparative examples were mounted in a printer ("FS-5250DN" manufactured by KYOCERA Document Solutions, Inc.). A difference between a blank paper portion potential in the absence of a transfer bias and a blank paper portion potential in the presence of a transfer bias, was evaluated as transfer memory. Note that, in the printer used in evaluation, an electrifiable rubber roller (an epichlorohydrin resin in which conductive carbon is dispersed) was employed as a charger. An intermediate transfer system was employed. In the intermediate transfer system, a toner image on a drum is transferred to a transfer belt before being transferred to a paper medium. After a one-hour durability test printing was performed, an image for evaluation was printed. A defect in the evaluation image was evaluated. For the evaluation of the image defect, an evaluation printer was used which includes a charging roller for applying a direct-current voltage to the charger. After the one-hour durability test printing was performed using the printer, a printed image was visually inspected to find out the presence or absence of a defect. The image evaluation was performed based on the following criteria.

Very good: no image defect is observed

Good: a blank portion with a size of 10 mm by 10 mm, which is an image defect, is observed as a ghost in a halftone portion.

Average: a blank portion with a size of 10 mm by 10 mm, which is an image defect, is observed as a ghost in a halftone portion, and an alphabet type blank portion with a size of 3 mm by 3 mm is observed as a ghost, although the alphabet type blank portion is not clearly read.

Not good: an alphabet type blank with a size of 3 mm by 3 mm, which is an image defect, is clearly read as a ghost.

A very good or good image was judged to succeed in the examination.

Transfer memory potentials (V) and the results of the image evaluation are shown in Table 2.

TABLE 2

| | Hole transport material | Electron transport material | Charge generating material | Resin | Transfer memory potential (V) | Image |
|---|---|---|---|---|---|---|
| Example 1 | HTM-1 | ETM-1 | X—$H_2$Pc | Resin 1 | −10 | Very good |
| Example 2 | HTM-2 | ETM-1 | X—$H_2$Pc | Resin 1 | −9 | Very good |
| Example 3 | HTM-3 | ETM-1 | X—$H_2$Pc | Resin 1 | −8 | Very good |
| Example 4 | HTM-4 | ETM-1 | X—$H_2$Pc | Resin 1 | −7 | Very good |
| Example 5 | HTM-5 | ETM-1 | X—$H_2$Pc | Resin 1 | −7 | Very good |
| Example 6 | HTM-6 | ETM-1 | X—$H_2$Pc | Resin 1 | −8 | Very good |
| Example 7 | HTM-7 | ETM-1 | X—$H_2$Pc | Resin 1 | −9 | Very good |
| Example 8 | HTM-8 | ETM-1 | X—$H_2$Pc | Resin 1 | −7 | Very good |
| Example 9 | HTM-9 | ETM-1 | X—$H_2$Pc | Resin 1 | −7 | Very good |
| Example 10 | HTM-10 | ETM-1 | X—$H_2$Pc | Resin 1 | −9 | Very good |

TABLE 2-continued

| | Hole transport material | Electron transport material | Charge generating material | Resin | Transfer memory potential (V) | Image |
|---|---|---|---|---|---|---|
| Example 11 | HTM-1 | ETM-2 | X—$H_2Pc$ | Resin 1 | −10 | Very good |
| Example 12 | HTM-2 | ETM-2 | X—$H_2Pc$ | Resin 1 | −10 | Very good |
| Example 13 | HTM-3 | ETM-2 | X—$H_2Pc$ | Resin 1 | −7 | Very good |
| Example 14 | HTM-4 | ETM-2 | X—$H_2Pc$ | Resin 1 | −9 | Very good |
| Example 15 | HTM-5 | ETM-2 | X—$H_2Pc$ | Resin 1 | −8 | Very good |
| Example 16 | HTM-6 | ETM-2 | X—$H_2Pc$ | Resin 1 | −8 | Very good |
| Example 17 | HTM-7 | ETM-2 | X—$H_2Pc$ | Resin 1 | −8 | Very good |
| Example 18 | HTM-8 | ETM-2 | X—$H_2Pc$ | Resin 1 | −10 | Very good |
| Example 19 | HTM-9 | ETM-2 | X—$H_2Pc$ | Resin 1 | −10 | Very good |
| Example 20 | HTM-10 | ETM-2 | X—$H_2Pc$ | Resin 1 | −9 | Very good |
| Example 21 | HTM-1 | ETM-3 | X—$H_2Pc$ | Resin 1 | −8 | Very good |
| Example 22 | HTM-2 | ETM-3 | X—$H_2Pc$ | Resin 1 | −10 | Very good |
| Example 23 | HTM-3 | ETM-3 | X—$H_2Pc$ | Resin 1 | −9 | Very good |
| Example 24 | HTM-4 | ETM-3 | X—$H_2Pc$ | Resin 1 | −11 | Very good |
| Example 25 | HTM-5 | ETM-3 | X—$H_2Pc$ | Resin 1 | −9 | Very good |
| Example 26 | HTM-6 | ETM-3 | X—$H_2Pc$ | Resin 1 | −8 | Very good |
| Example 27 | HTM-7 | ETM-3 | X—$H_2Pc$ | Resin 1 | −8 | Very good |
| Example 28 | HTM-8 | ETM-3 | X—$H_2Pc$ | Resin 1 | −9 | Very good |
| Example 29 | HTM-9 | ETM-3 | X—$H_2Pc$ | Resin 1 | −10 | Very good |
| Example 30 | HTM-10 | ETM-3 | X—$H_2Pc$ | Resin 1 | −10 | Very good |
| Example 31 | HTM-8 | ETM-1 | X—$H_2Pc$ | Resin 2 | −8 | Very good |
| Example 32 | HTM-8 | ETM-1 | X—$H_2Pc$ | Resin 3 | −9 | Very good |
| Example 33 | HTM-8 | ETM-1 | X—$H_2Pc$ | Resin 4 | −10 | Very good |
| Example 34 | HTM-8 | ETM-1 | X—$H_2Pc$ | Resin 5 | −12 | Very good |
| Example 35 | HTM-8 | ETM-1 | X—$H_2Pc$ | Resin 6 | −12 | Very good |
| Example 36 | HTM-8 | ETM-1 | TiOPc | Resin 1 | −10 | Very good |
| Example 37 | HTM-8 | ETM-4 | X—$H_2Pc$ | Resin 1 | −42 | Good |
| Example 38 | HTM-8 | ETM-5 | X—$H_2Pc$ | Resin 1 | −46 | Good |
| Com. Ex. 1 | HTM-11 | ETM-1 | X—$H_2Pc$ | Resin 1 | −62 | Not good |
| Com. Ex. 2 | HTM-11 | ETM-2 | X—$H_2Pc$ | Resin 1 | −65 | Not good |
| Com. Ex. 3 | HTM-11 | ETM-3 | X—$H_2Pc$ | Resin 1 | −69 | Not good |
| Com. Ex. 4 | HTM-1 | ETM-6 | X—$H_2Pc$ | Resin 1 | −20 | Average |
| Com. Ex. 5 | HTM-1 | ETM-7 | X—$H_2Pc$ | Resin 1 | −40 | Not good |
| Com. Ex. 6 | HTM-1 | ETM-8 | X—$H_2Pc$ | Resin 1 | −45 | Not good |
| Com. Ex. 7 | HTM-8 | ETM-6 | X—$H_2Pc$ | Resin 1 | −22 | Average |
| Com. Ex. 8 | HTM-8 | ETM-7 | X—$H_2Pc$ | Resin 1 | −50 | Not good |
| Com. Ex. 9 | HTM-8 | ETM-8 | X—$H_2Pc$ | Resin 1 | −58 | Not good |

Com. Ex.: Comparative Example

The positively chargeable monolayer electrophotographic photosensitive members of Examples 1-38 each included a photosensitive layer containing a triarylamine derivative represented by the formula (1) as a hole transport material and a compound represented by any of the formulas (2)-(4) as an electron transport material. These photosensitive members reduced or prevented transfer memory, whereby a satisfactory image which does not have an image defect, such as a ghost, was formed.

The positively chargeable monolayer electrophotographic photosensitive members of Comparative Examples 1-3 included a photosensitive layer containing a compound represented by any of the formulas (2)-(4) as an electron transport material. However, a compound other than the triarylamine derivatives represented by the formula (I) was contained as a hole transport material in the photosensitive layer. These photosensitive members did not reduce or prevent transfer memory.

The positively chargeable monolayer electrophotographic photosensitive members of Comparative Examples 4-9 each included a photosensitive layer containing a triarylamine derivative represented by the formula (1) as a hole transport material. However, a compound other than the compounds represented by the formulas (2)-(4) was contained as an electron transport material in the photosensitive layer. These photosensitive members did not reduce or prevent transfer memory.

What is claimed is:

1. A positively chargeable monolayer electrophotographic photosensitive member comprising:

a conductive substrate; and a photosensitive layer provided on the conductive substrate and having a monolayer structure containing a charge generating material, a hole transport material, an electron transport material, and a binder resin, wherein the hole transport material contains a triarylamine derivative represented by a following formula (1):

(1)

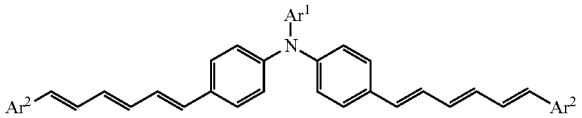

where $Ar^1$ is an aryl group, or a heterocyclic group having a conjugated double bond, $Ar^2$ is an aryl group, and $Ar^1$ and $Ar^2$ are optionally substituted by one or more groups selected from the group consisting of alkyl group having 1-6 carbon atoms, alkoxy group having 1-6 carbon atoms, and phenoxy group, and the electron transport material contains at least one compound selected from the group consisting of compounds represented by following formulas (2)-(4):

(2)

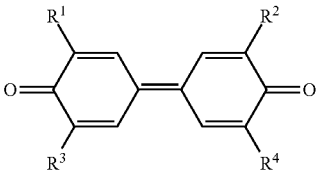

(3)

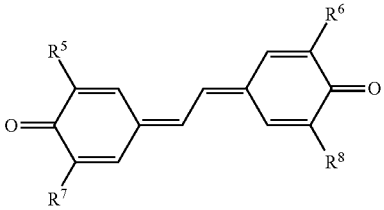

(4)

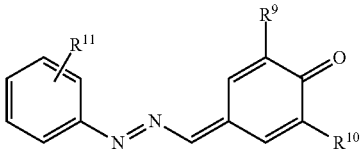

where each of $R^1$-$R^{10}$ is independently a group selected from the group consisting of hydrogen atom, optionally substituted alkyl group, optionally substituted alkenyl group, optionally substituted alkoxy group, optionally substituted aralkyl group, optionally substituted aromatic hydrocarbon group, and optionally substituted heterocyclic group, and $R^{11}$ is a group selected from the group consisting of halogen atom, hydrogen atom, optionally substituted alkyl group, optionally substituted alkenyl group, optionally substituted alkoxy group, optionally substituted aralkyl group, optionally substituted aromatic hydrocarbon group, and optionally substituted heterocyclic group.

2. A positively chargeable monolayer electrophotographic photosensitive member according to claim 1, wherein the electron transport material has a drift mobility of at least $4.5\times10^{-7}$ $cm^2V\cdot sec$ in the presence of an electric field having a field intensity of $3.0\times10^5$ V/cm.

3. A positively chargeable monolayer electrophotographic photosensitive member according to claim 1, wherein the electron transport material has a reduction potential of at least −1.05 V and not more than −0.85 V versus $Ag/Ag^+$.

4. A positively chargeable monolayer electrophotographic photosensitive member according to claim 1, wherein the electron transport material has a molecular weight of not more than 400.

5. A positively chargeable monolayer electrophotographic photosensitive member according to claim 1, wherein the charge generating material is X-form metal-free phthalocyanine or oxotitanyl phthalocyanine.

6. A positively chargeable monolayer electrophotographic photosensitive member according to claim 1, wherein the binder resin contains a polycarbonate resin represented by a following formula (5):

(5)

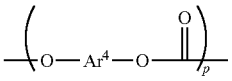

-continued

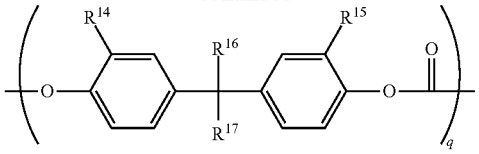

where p+q=1 and p is 0-0.7, and $Ar^4$ is one selected from divalent groups represented by formulas (5-1)-(5-3):

(5-1)

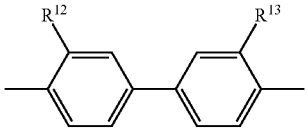

(5-2)

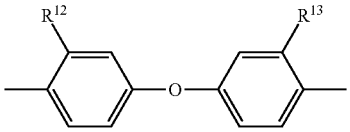

(5-3)

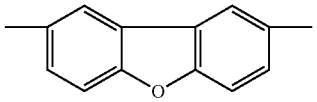

where each of $R^{12}$-$R^{17}$ is independently a hydrogen atom, an alkyl group, or an aryl group, and $R^{16}$ and $R^{17}$ are optionally bonded together to form a cycloalkylidene group.

7. A positively chargeable monolayer electrophotographic photosensitive member according to claim 6, wherein the binder resin is the resin represented by the formula (5), and $R^{16}$ and $R^{17}$ are bonded together to form a cycloalkylidene group.

8. A positively chargeable monolayer electrophotographic photosensitive member according to claim 1, wherein in an image forming apparatus including a contact charger for applying a direct-current voltage, the positively chargeable monolayer electrophotographic photosensitive member is used as an image bearing member.

9. A positively chargeable monolayer electrophotographic photosensitive member according to claim 1, wherein the two $Ar^2$s are the same in the triarylamine derivative represented by the formula (1).

10. An image forming apparatus comprising:

an image bearing member;

a charger configured to charge a surface of the image bearing member;

an exposure unit configured to expose the charged surface of the image bearing member to light to form an electrostatic latent image on the surface of the image bearing member;

a development unit configured to develop the electrostatic latent image as a toner image; and a transfer unit configured to transfer the toner image from the image bearing member to a transfer member, wherein the image bearing member is the positively chargeable monolayer electrophotographic photosensitive member according to claim 1.

11. An image forming apparatus according to claim 10, wherein the charger is a contact charger configured to apply a direct-current voltage.

12. An image forming apparatus according to claim 11, wherein in the transfer unit, transfer is performed in a direct transfer system.

* * * * *